US008721436B2

(12) United States Patent
Hamlin et al.

(10) Patent No.: US 8,721,436 B2
(45) Date of Patent: May 13, 2014

(54) SYSTEMS, METHODS AND DEVICES FOR CONFIGURING WAGERING GAME DEVICES BASED ON SHARED DATA

(71) Applicant: WMS Gaming Inc., Waukegan, IL (US)

(72) Inventors: Vernon W. Hamlin, Lisle, IL (US); Craig J. Sylla, Round Lake, IL (US); Paul A. Quaglia, Westmont, IL (US); Scot W. Salzman, Buffalo Grove, IL (US); Srinivyasa M. Adiraju, Vernon Hills, IL (US); Mark C. Pace, Palatine, IL (US)

(73) Assignee: WMS Gaming Inc., Waukegan, IL (US)

( * ) Notice: Subject to any disclaimer, the term of this patent is extended or adjusted under 35 U.S.C. 154(b) by 0 days.

(21) Appl. No.: 13/776,984

(22) Filed: Feb. 26, 2013

(65) Prior Publication Data

US 2014/0051499 A1 Feb. 20, 2014

Related U.S. Application Data

(60) Provisional application No. 61/693,543, filed on Aug. 27, 2012, provisional application No. 61/684,284, filed on Aug. 17, 2012.

(51) Int. Cl.
*A63F 9/24* (2006.01)

(52) U.S. Cl.
USPC ..... 463/25; 463/42

(58) Field of Classification Search
USPC ..... 463/25, 40–43
See application file for complete search history.

(56) References Cited

U.S. PATENT DOCUMENTS

| | | | | |
|---|---|---|---|---|
| 4,527,798 | A | 7/1985 | Siekierski et al. | 273/86 R |
| 4,805,907 | A | 2/1989 | Hagiwara | 273/138 A |
| 4,856,787 | A | 8/1989 | Itkis | 273/237 |
| 4,858,930 | A | 8/1989 | Sato | 273/85 |
| 4,861,041 | A | 8/1989 | Jones et al. | 273/292 |
| 4,964,638 | A | 10/1990 | Ishida | 273/138 A |

(Continued)

FOREIGN PATENT DOCUMENTS

| | | | |
|---|---|---|---|
| AU | 2005251830 | 12/2005 | A63F 13/12 |
| EP | 0829834 | 3/1998 | G07F 17/32 |

(Continued)

OTHER PUBLICATIONS

Levinthal, A. et al. "Silicon Gaming Odyssey Slot Machine." Proceedings of COMPCON 97, 1997 (6 pages).

*Primary Examiner* — Masud Ahmed
(74) *Attorney, Agent, or Firm* — Nixon Peabody LLP

(57) ABSTRACT

Gaming devices, gaming systems, methods of configuring gaming devices, and computer programs for configuring gaming devices are featured. A gaming machine is disclosed for communicatively coupling to peer gaming machines via a peer-to-peer network. The gaming machine includes a display device(s), a processor(s), and a memory device(s) storing instructions that cause the gaming machine to: store a first set of data indicative of the gaming machine's configuration parameters and a second set of data indicative of the gaming machine's performance; receive from one or more peer gaming machines a third set of data indicative of the peer gaming machine's(s') configuration parameters and a fourth set of data indicative of the peer gaming machine's(s') performance; analyze the third and fourth data sets to determine modifications to the gaming machine's configuration parameters to improve machine performance; and, automatically modify at least one configuration parameter of the gaming machine based upon the analysis.

25 Claims, 6 Drawing Sheets

(56) References Cited

U.S. PATENT DOCUMENTS

| | | | | |
|---|---|---|---|---|
| 5,042,810 | A | 8/1991 | Williams | 273/142 |
| 5,083,271 | A | 1/1992 | Thacher et al. | 341/411 |
| 5,116,055 | A | 5/1992 | Tracy | 273/138 A |
| 5,249,800 | A | 10/1993 | Hilgendorf et al. | 273/138 A |
| 5,280,909 | A | 1/1994 | Tracy | 273/138 A |
| 5,344,144 | A | 9/1994 | Canon | 273/138 A |
| 5,397,133 | A | 3/1995 | Penzias | 273/439 |
| 5,489,103 | A | 2/1996 | Okamoto | 273/433 |
| 5,564,700 | A | 10/1996 | Celona | 463/27 |
| 5,580,309 | A | 12/1996 | Piechowiak et al. | 463/16 |
| 5,586,937 | A | 12/1996 | Menashe | 463/41 |
| 5,588,650 | A | 12/1996 | Eman et al. | 273/142 B |
| 5,611,730 | A | 3/1997 | Weiss | 463/20 |
| 5,655,961 | A | 8/1997 | Acres et al. | 463/27 |
| 5,674,128 | A | 10/1997 | Holch et al. | 463/42 |
| 5,707,286 | A | 1/1998 | Carlson | 463/16 |
| 5,743,523 | A | 4/1998 | Kelly et al. | 273/138.1 |
| 5,759,102 | A | 6/1998 | Pease et al. | 463/42 |
| 5,761,647 | A | 6/1998 | Boushy | 705/10 |
| 5,761,649 | A | 6/1998 | Hill | 705/27 |
| 5,762,552 | A | 6/1998 | Vuong et al. | 463/25 |
| 5,770,533 | A | 6/1998 | Franchi | 463/42 |
| 5,800,268 | A | 9/1998 | Molnick | 463/40 |
| 5,816,918 | A | 10/1998 | Kelly et al. | 463/16 |
| 5,823,879 | A | 10/1998 | Golgberg et al. | 463/42 |
| 5,830,069 | A | 11/1998 | Soltesz et al. | 463/45 |
| 5,851,149 | A | 12/1998 | Xidos et al. | 463/42 |
| 5,876,284 | A | 3/1999 | Acres et al. | 463/25 |
| 5,885,158 | A | 3/1999 | Torango et al. | 463/27 |
| 5,941,773 | A | 8/1999 | Harlick | 463/26 |
| 5,971,271 | A | 10/1999 | Wynn et al. | 235/380 |
| 5,971,849 | A | 10/1999 | Falciglia | 463/16 |
| 5,999,808 | A | 12/1999 | LaDue | 455/412 |
| 6,001,016 | A | 12/1999 | Walker et al. | 463/42 |
| 6,003,013 | A | 12/1999 | Boushy et al. | 705/10 |
| 6,012,982 | A | 1/2000 | Piechowiak et al. | 463/16 |
| 6,012,983 | A | 1/2000 | Walker et al. | 463/20 |
| 6,012,984 | A | 1/2000 | Roseman | 463/42 |
| 6,026,433 | A | 2/2000 | D'Arlach et al. | 709/217 |
| 6,068,552 | A | 5/2000 | Walker et al. | 463/21 |
| 6,077,162 | A | 6/2000 | Weiss | 463/26 |
| 6,080,062 | A | 6/2000 | Olson | 463/42 |
| 6,089,975 | A | 7/2000 | Dunn | 463/16 |
| 6,089,980 | A | 7/2000 | Gauselmann | 463/27 |
| 6,104,815 | A | 8/2000 | Alcorn et al. | 380/251 |
| 6,110,041 | A | 8/2000 | Walker et al. | 463/20 |
| 6,110,043 | A | 8/2000 | Olsen | 463/27 |
| 6,113,495 | A | 9/2000 | Walker et al. | 463/42 |
| 6,117,011 | A | 9/2000 | Lvov | 463/25 |
| 6,135,884 | A | 10/2000 | Hedrick et al. | 463/20 |
| 6,135,887 | A | 10/2000 | Pease et al. | 463/42 |
| 6,146,273 | A | 11/2000 | Olsen | 463/27 |
| 6,149,522 | A | 11/2000 | Alcorn et al. | 463/29 |
| 6,183,362 | B1 | 2/2001 | Boushy | 463/25 |
| 6,183,366 | B1 | 2/2001 | Goldberg et al. | 463/42 |
| 6,196,920 | B1 | 3/2001 | Spaur et al. | 463/42 |
| 6,204,560 | B1 | 3/2001 | Daetwyler et al. | 257/745 |
| 6,210,274 | B1 | 4/2001 | Carlson | 463/16 |
| 6,241,608 | B1 | 6/2001 | Torango | 463/27 |
| 6,264,557 | B1 | 7/2001 | Schneier et al. | 463/29 |
| 6,264,561 | B1 | 7/2001 | Saffari et al. | 463/42 |
| 6,272,223 | B1 | 8/2001 | Carlson | 380/251 |
| 6,273,821 | B1 | 8/2001 | Moriguchi | 463/42 |
| 6,286,003 | B1 | 9/2001 | Muta | 707/10 |
| 6,287,200 | B1 | 9/2001 | Sharma | 463/40 |
| 6,334,104 | B1 | 12/2001 | Hirai | 704/258 |
| 6,346,048 | B1 | 2/2002 | Ogawa et al. | 463/42 |
| 6,354,946 | B1 | 3/2002 | Finn | 463/40 |
| 6,361,437 | B1 | 3/2002 | Walker et al. | 463/23 |
| 6,402,618 | B1 | 6/2002 | Reed et al. | 463/40 |
| 6,406,371 | B1 | 6/2002 | Baba et al. | 463/42 |
| 6,409,602 | B1 | 6/2002 | Wiltshire et al. | 463/42 |
| 6,428,413 | B1 | 8/2002 | Carlson | 463/16 |
| 6,434,398 | B1 | 8/2002 | Inselberg | 455/517 |
| 6,454,650 | B1 | 9/2002 | Aronin | 463/17 |
| RE37,885 | E | 10/2002 | Acres et al. | 463/42 |
| 6,488,580 | B1 | 12/2002 | Robb | 463/23 |
| 6,508,709 | B1 | 1/2003 | Karmakar | 463/42 |
| 6,508,710 | B1 | 1/2003 | Paravia et al. | 463/42 |
| 6,517,433 | B2 | 2/2003 | Loose et al. | 463/20 |
| 6,554,710 | B1 | 4/2003 | Olson | 463/42 |
| 6,560,639 | B1 | 5/2003 | Dan et al. | 709/218 |
| 6,592,460 | B2 | 7/2003 | Torango | 463/27 |
| 6,645,077 | B2 | 11/2003 | Rowe | 463/42 |
| 6,652,378 | B2 | 11/2003 | Cannon et al. | 463/20 |
| 6,749,510 | B2 | 6/2004 | Giobbi | 463/42 |
| 6,805,634 | B1 | 10/2004 | Wells et al. | 463/42 |
| 6,843,725 | B2 | 1/2005 | Nelson | 463/40 |
| 6,860,810 | B2 | 3/2005 | Cannon et al. | 463/20 |
| 6,884,173 | B2 | 4/2005 | Gauselmann | 463/42 |
| RE38,812 | E | 10/2005 | Acres et al. | 463/26 |
| 6,955,604 | B1 | 10/2005 | Graves et al. | 463/42 |
| 6,986,055 | B2 | 1/2006 | Carlson | 713/200 |
| 7,056,215 | B1 | 6/2006 | Olive | 463/27 |
| 7,083,520 | B2 | 8/2006 | Rowe | 463/42 |
| 7,108,603 | B2 | 9/2006 | Olive | 463/27 |
| 7,144,321 | B2 | 12/2006 | Mayeroff | 463/16 |
| 7,260,834 | B1 | 8/2007 | Carlson | 726/4 |
| 7,285,049 | B1 | 10/2007 | Luciano, Jr. et al. | 463/42 |
| 7,311,601 | B2 | 12/2007 | Anderson et al. | 463/20 |
| 7,316,619 | B2 | 1/2008 | Nelson | 463/42 |
| 7,455,591 | B2 * | 11/2008 | Nguyen | 463/42 |
| 7,470,196 | B1 | 12/2008 | Joshi | 463/42 |
| 7,476,153 | B2 | 1/2009 | Walker et al. | 463/20 |
| 7,641,555 | B2 | 1/2010 | McKinley et al. | 463/43 |
| 7,722,466 | B2 | 5/2010 | Rothschild | 463/42 |
| 7,896,741 | B2 | 3/2011 | Kuehling et al. | 463/29 |
| 7,934,993 | B2 | 5/2011 | Kuehling et al. | 463/29 |
| 8,029,360 | B2 | 10/2011 | Lind et al. | 463/29 |
| 8,029,365 | B2 | 10/2011 | Burke et al. | 463/42 |
| 8,083,585 | B2 | 12/2011 | Brosnan | 463/29 |
| 8,100,755 | B2 * | 1/2012 | Enzminger | 463/22 |
| 8,142,291 | B2 | 3/2012 | Ryan | 463/43 |
| 8,323,101 | B2 | 12/2012 | Anderson et al. | 463/27 |
| 2001/0044337 | A1 | 11/2001 | Rowe et al. | 463/29 |
| 2001/0044339 | A1 | 11/2001 | Cordero et al. | 463/42 |
| 2002/0032049 | A1 | 3/2002 | Walker et al. | 463/16 |
| 2002/0037767 | A1 | 3/2002 | Ebin | 463/25 |
| 2002/0045484 | A1 | 4/2002 | Eck et al. | 463/42 |
| 2002/0068631 | A1 | 6/2002 | Raverdy et al. | 463/42 |
| 2002/0071557 | A1 | 6/2002 | Nguyen | 380/251 |
| 2002/0073043 | A1 | 6/2002 | Herman et al. | 705/64 |
| 2002/0087876 | A1 | 7/2002 | Larose | 713/200 |
| 2002/0094869 | A1 | 7/2002 | Harkham | 463/42 |
| 2002/0107072 | A1 | 8/2002 | Giobbi | 463/42 |
| 2002/0116615 | A1 | 8/2002 | Nguyen et al. | 713/168 |
| 2002/0137217 | A1 | 9/2002 | Rowe | 436/42 |
| 2002/0138594 | A1 | 9/2002 | Rowe | 709/219 |
| 2002/0142841 | A1 | 10/2002 | Boushy | 463/42 |
| 2002/0142846 | A1 | 10/2002 | Paulsen | 463/43 |
| 2002/0147047 | A1 | 10/2002 | Letovsky et al. | 463/42 |
| 2003/0028567 | A1 | 2/2003 | Carlson | 708/250 |
| 2003/0064771 | A1 | 4/2003 | Morrow et al. | 463/16 |
| 2003/0083943 | A1 | 5/2003 | Adams et al. | 705/14 |
| 2003/0162589 | A1 | 8/2003 | Nguyen et al. | 463/25 |
| 2003/0190959 | A1 | 10/2003 | Olson | 463/42 |
| 2003/0195043 | A1 | 10/2003 | Shinners et al. | 463/42 |
| 2003/0216182 | A1 | 11/2003 | Gauselmann | 463/40 |
| 2004/0158536 | A1 | 8/2004 | Kowal et al. | 705/400 |
| 2004/0166940 | A1 | 8/2004 | Rothschild | 463/42 |
| 2004/0209660 | A1 | 10/2004 | Carlson et al. | 463/1 |
| 2005/0054419 | A1 | 3/2005 | Souza et al. | 463/20 |
| 2005/0193209 | A1 | 9/2005 | Saunders et al. | 713/182 |
| 2006/0073887 | A1 | 4/2006 | Nguyen et al. | 463/27 |
| 2006/0073888 | A1 | 4/2006 | Nguyen et al. | 463/27 |
| 2006/0142079 | A1 | 6/2006 | Ikehara et al. | 463/27 |
| 2006/0165235 | A1 | 7/2006 | Carlson | 380/268 |
| 2006/0264256 | A1 | 11/2006 | Gagner et al. | 463/20 |
| 2006/0287098 | A1 | 12/2006 | Morrow et al. | 463/42 |
| 2007/0060314 | A1 | 3/2007 | Baerlocher et al. | 463/25 |
| 2007/0060321 | A1 | 3/2007 | Vasquez et al. | 463/27 |
| 2007/0077990 | A1 | 4/2007 | Cuddy et al. | 463/25 |
| 2007/0191088 | A1 | 8/2007 | Breckner et al. | 463/20 |
| 2007/0232392 | A1 | 10/2007 | Pace | 463/29 |

(56) References Cited

U.S. PATENT DOCUMENTS

| | | | | |
|---|---|---|---|---|
| 2007/0259709 | A1 | 11/2007 | Kelly et al. | 463/20 |
| 2007/0293293 | A1 | 12/2007 | Baerlocher et al. | 463/16 |
| 2007/0298857 | A1 | 12/2007 | Schlottmann et al. | 463/16 |
| 2007/0298874 | A1 | 12/2007 | Baerlocher et al. | 463/27 |
| 2007/0298875 | A1 | 12/2007 | Baerlocher et al. | 463/27 |
| 2008/0020830 | A1 | 1/2008 | Ikehara et al. | 463/27 |
| 2008/0020831 | A1 | 1/2008 | Ikehara et al. | 463/27 |
| 2008/0020832 | A1 | 1/2008 | Iddings et al. | 463/27 |
| 2008/0020833 | A1 | 1/2008 | Baerlocher et al. | 463/27 |
| 2008/0020834 | A1 | 1/2008 | Breckner et al. | 463/27 |
| 2008/0020846 | A1 | 1/2008 | Vasquez et al. | 463/42 |
| 2008/0045344 | A1 | 2/2008 | Schlottmann et al. | 463/42 |
| 2008/0064501 | A1 | 3/2008 | Patel | 463/40 |
| 2008/0064502 | A1 | 3/2008 | Schlottmann et al. | 463/42 |
| 2008/0070680 | A1 | 3/2008 | Baerlocher et al. | 463/27 |
| 2008/0070692 | A1 | 3/2008 | Schlottmann et al. | 463/42 |
| 2008/0070693 | A1 | 3/2008 | Schlottmann et al. | 463/42 |
| 2008/0070694 | A1 | 3/2008 | Schlottmann et al. | 463/42 |
| 2008/0070695 | A1 | 3/2008 | Baerlocher et al. | 463/42 |
| 2008/0070702 | A1 | 3/2008 | Kaminkow et al. | 463/46 |
| 2008/0076514 | A1 | 3/2008 | Baerlocher et al. | 463/20 |
| 2008/0076515 | A1 | 3/2008 | Baerlocher et al. | 463/20 |
| 2008/0076517 | A1 | 3/2008 | Baerlocher et al. | 463/20 |
| 2008/0076547 | A1 | 3/2008 | Bigelow et al. | 463/29 |
| 2008/0076552 | A1 | 3/2008 | Baerlocher et al. | 463/31 |
| 2008/0146344 | A1 | 6/2008 | Rowe et al. | 463/42 |
| 2008/0153588 | A1 | 6/2008 | Muir et al. | 463/29 |
| 2009/0325686 | A1 | 12/2009 | Davis et al. | 463/25 |
| 2010/0062196 | A1 | 3/2010 | Bezek et al. | 428/35.2 |
| 2010/0069160 | A1 | 3/2010 | Barrett et al. | 463/46 |
| 2010/0106823 | A1 | 4/2010 | Davis et al. | 709/224 |
| 2010/0234097 | A1 | 9/2010 | Gelber et al. | 463/25 |
| 2010/0234099 | A1 | 9/2010 | Rasmussen et al. | 463/29 |
| 2010/0285865 | A1* | 11/2010 | Enzminger | 463/22 |
| 2010/0298040 | A1 | 11/2010 | Joshi et al. | 463/16 |
| 2012/0042000 | A1* | 2/2012 | Heins et al. | 709/201 |
| 2012/0046110 | A1 | 2/2012 | Amaitis et al. | 463/42 |
| 2012/0058814 | A1 | 3/2012 | Lutnick et al. | 463/25 |
| 2012/0172123 | A1 | 7/2012 | Beaulieu et al. | 463/31 |
| 2013/0165211 | A1* | 6/2013 | Graham et al. | 463/25 |

FOREIGN PATENT DOCUMENTS

| | | | |
|---|---|---|---|
| EP | 0843272 | 5/1998 | G07F 17/32 |
| EP | 1231577 | 8/2002 | G07F 17/32 |
| EP | 1363252 | 11/2003 | G07F 17/32 |
| EP | 1463008 | 9/2004 | A63F 13/12 |
| EP | 1469436 | 10/2004 | A63F 9/24 |
| WO | 96/11730 | 4/1996 | A63F 13/12 |
| WO | 97/12338 | 4/1997 | A63F 9/22 |
| WO | 97/27568 | 7/1997 | G07F 17/34 |
| WO | 98/35309 | 8/1998 | G06F 19/00 |
| WO | 01/91866 | 12/2001 | G07F 17/32 |
| WO | 2004/034223 | 4/2004 | G07F 17/32 |
| WO | 02/32526 | 4/2005 | A63F 13/12 |
| WO | 2005/120672 | 12/2005 | A63F 13/12 |
| WO | 2006/076185 | 7/2006 | A63F 13/00 |
| WO | 2007/089410 | 9/2007 | A63F 9/24 |
| WO | 2007/139988 | 12/2007 | G06F 19/00 |
| WO | 2008/030904 | 3/2008 | A63F 9/24 |
| WO | 2008/060426 | 5/2008 | A63F 1/00 |
| WO | 2008/060442 | 5/2008 | A63F 13/10 |
| WO | 2008/060459 | 5/2008 | A63F 13/10 |
| WO | 2008/060513 | 5/2008 | A63F 13/10 |
| WO | 2008/063408 | 5/2008 | A63F 13/10 |

* cited by examiner

SYSTEMS, METHODS AND DEVICES FOR CONFIGURING WAGERING GAME DEVICES BASED ON SHARED DATA

CLAIM OF PRIORITY AND CROSS-REFERENCE TO RELATED APPLICATIONS

This application claims the benefit of and priority to U.S. Provisional Patent Application No. 61/693,543, which was filed on Aug. 27, 2012, and U.S. Provisional Patent Application No. 61/684,284, which was filed on Aug. 17, 2012, both of which are incorporated herein by reference in their respective entireties.

COPYRIGHT

A portion of the disclosure of this patent document contains material which is subject to copyright protection. The copyright owner has no objection to the facsimile reproduction by anyone of the patent disclosure as it appears in the U.S. Patent and Trademark Office patent files or records, but otherwise reserves all copyright rights whatsoever.

TECHNICAL FIELD

The present disclosure relates generally to wagering games, as well as wagering game terminals and wagering game systems. More particularly, the present disclosure relates to systems, methods, and devices for configuring wagering game systems, wagering game terminals, portable gaming devices, web-based and interactive gaming devices, and the like.

BACKGROUND

Gaming terminals, such as slot machines, video poker machines and the like, have been a cornerstone of the gaming industry for several years. Generally, the popularity of such machines with players is dependent on the likelihood (or perceived likelihood) of winning money at the machine and the intrinsic entertainment value of the machine relative to other available gaming options. Where the available gaming options include a number of competing machines and the expectation of winning at each machine is roughly the same (or believed to be the same), players are likely to be attracted to the most entertaining and exciting machines. Shrewd operators consequently strive to employ the most entertaining and exciting machines, features, and enhancements available because such machines attract frequent play and hence increase profitability to the operator. Thus, gaming manufacturers continuously strive to develop new games and improved gaming enhancements that will attract frequent play and increased player loyalty through enhanced entertainment value to the player.

There are three main types of wagering game machines: mechanical, electromechanical, and electronic. The original slot machine, for example, was entirely mechanical in construction, working on an elaborate configuration of springs, gears, shafts, brakes and levers. Since its introduction in the early 1960's, the electromechanical gaming machine began replacing most, if not all, mechanical slot machines. Electromechanical gaming machines typically use one or more microprocessors to determine a random outcome, and electrical stepper motors to spin and stop a set of mechanical reels. The electronic gaming machine (EGM), in comparison, subsequently supplanted the mechanical reels of the electromechanical gaming machine with simulated mechanical reels generated by a video display device. In addition to slot-type wagering games, traditional table games, such as poker, blackjack, keno, and bingo, were adapted for use on EGM's.

The use of microprocessors has significantly advanced the state of the art of electronic gaming. For instance, microprocessors offer gaming machines much greater latitude in determining random game outcomes. Random game outcomes are typically determined by a random number generator (RNG) that is driven by a central processing unit (CPU). A probability table contains all possible game outcomes, with each game outcome being linked to a distinct number. Once generated, the random number is used to look up the corresponding game outcome in the probability table. The CPU then signals the stepper motors to drive and position the reels to coincide with the randomly determined game outcome. Microprocessor-driven EGM's allow gaming manufacturers to design slot games with more flexible pay tables. In a specific example, microprocessor-driven gaming machines can offer high value, low probability awards while contemporaneously offering low value, high probability awards—offering a range of awards that an all-mechanical slot machine cannot.

The increased power of modern microprocessors has enabled the introduction of new gaming machine capabilities that allow the addition of entirely new classes of features and functions. Many EGM designs allow these features and functions to be enabled in a variety of different combinations to operate on a wide variety of different technological platforms. Enabling these features oftentimes requires they be configured to casino specifications, without departing from state gaming regulations, when the EGM's are first set up on the casino floor. These configuration parameters can enable the gaming machine to network with the casino's existing central computer systems, for example, to coordinate with the casino's cashless gaming systems, wagering processes, accounting procedures, player-tracking data collection, etc.

Networking a gaming machine to a gaming establishment's central computer system typically requires the machine be configured to establish communication, including selection of communication protocols for communication between the gaming machine and host system. This may include selection of the host ports for electronic funds transfers, establishing gaming machine communication addresses, host communication protocol bonus control, etc. As part of the initial set up process, a number of configuration parameters may also be set to customize the gaming machine, for example, to comport with the wagering processes used by a particular gaming establishment. These specifications can include the selection of payout devices (e.g., hopper, ticket printer, cashless player account, etc.), selection of payout options (e.g., split pays from both the hopper and ticket printer), and controlling ticket printer parameters. The gaming machine may also be configured to customize the presentation of the game. These configuration parameters can include, in some non-limiting examples: screen brightness, gaming machine lighting, speaker volume, presentation of multiple games, payback percentages, etc. Some additional miscellaneous configuration categories include: ticket-in control configuration, validation control, and gaming machine operating modes (including demonstration and diagnostic mode). Within each of these categories can be a number of different selections, and even sub-selections.

The number and complexity of configuration parameters can require considerable technician time during the initial EGM set up process. Historically, the configuration process required selecting and implementing operating parameters for each gaming machine—the gaming machine was manually configured through an extensive set of administrative menus. Some parameters require multiple menus and value entries to be completely configured. For some electronic gaming machines, the video display has a touch screen that can be used as an input device to configure the gaming machine. The technician is provided with instructions and options displayed on the video display for each configuration parameter, and the technician selects configuration parameters using the touch screen. This can become a time-consuming, tedious, and, in some instances, error-prone process, especially when numerous gaming machines must be configured.

Overcoming the problems associated with configuring hundreds, if not thousands, of gaming machines, whether they are electromechanical or electronic gaming machines, is an expensive, time-consuming process. This issue can be exacerbated when new gaming features and functions are introduced to the market, or certain gaming machines are underperforming when compared to their counterparts, and operators wish to configure/reconfigure multiple gaming machines that are out on the casino floor. What is needed are new methods and devices for configuring wagering game machines to increase the accuracy and efficiency of the configuration process.

SUMMARY

Aspects of the present disclosure are directed to systems, methods and devices for configuring wagering game systems and devices based on shared data. For example, disclosed is a gaming device peer-to-peer data exchange for sharing information about gaming device improvement and optimization. In some embodiments, the individual devices are configured to dynamically adjust their own configuration parameters based on the shared data to improve device performance. For some implementations, an individual or a group of gaming machines can advise and direct a new or underperforming gaming machine or group of gaming machines in real-time on how to reconfigure itself/themselves for the best yields based on the location and/or circumstances of that gaming machine/set of gaming machines using the collective knowledge generated by the group of gaming machines. These communications and determinations may be computed on and transmitted from an individual gaming machine to an individual gaming machine, from an individual gaming machine to a group or groups of gaming machines, from a group or groups of gaming machines to an individual gaming machine, and from a group or groups of gaming machines to a group or groups of gaming machines.

According to one aspect of the present disclosure, a gaming machine for communicatively coupling to one or more peer gaming machines via a peer-to-peer gaming network is disclosed. The gaming machine includes one or more display devices, one or more processors, and one or more memory devices. The one or more memory devices store instructions that, when executed by at least one of the one or more processors, cause the gaming machine to: store, via at least one of the one or more memory devices, a first set of data indicative of configuration parameters of the gaming machine, and a second set of data indicative of machine performance of the gaming machine; receive, from the one or more peer gaming machines via the peer-to-peer gaming network, a third set of data indicative of configuration parameters of the one or more peer gaming machines, and a fourth set of data indicative of machine performance of the one or more peer gaming machines; analyze, via at least one of the one or more processors, the third and fourth data sets to determine one or more modifications to the configuration parameters of the gaming machine to thereby improve the machine performance of the gaming machine; and, automatically modify at least one of the configuration parameters of the gaming machine based upon the results of the analysis.

In accordance with another aspect of the disclosure, one or more physical machine-readable storage media are featured which include instructions which, when executed by one or more processors, cause the one or more processors to perform operations to complete any of the disclosed methods. These operations may comprise: store on at least one memory device a first set of data indicative of configuration parameters of a gaming machine, and a second set of data indicative of machine performance of the gaming machine; receive from a peer gaming machine via a peer-to-peer gaming network a third set of data indicative of configuration parameters of the peer gaming machine, and a fourth set of data indicative of machine performance of the peer gaming machine; analyze the third and fourth sets of data to determine one or more modifications to the configuration parameters of the gaming machine to thereby improve the machine performance of the gaming machine; and, automatically modify at least one of the configuration parameters of the gaming machine based upon the results of the analysis.

Other aspects of the present disclosure are directed to a method of configuring gaming machines communicatively coupled together via a peer-to-peer gaming network. The method includes: storing, on a first one of the gaming machines, a first set of data indicative of the first gaming machine's configuration parameters and a second set of data indicative of the first gaming machine's machine performance; storing, on a second one of the gaming machines, a third set of data indicative of the second gaming machine's configuration parameters and a fourth set of data indicative of the second gaming machine's machine performance; transmitting the third and fourth data sets from the second gaming machine to the first gaming machine; analyzing, via the first gaming machine, the third and fourth data sets to determine one or more modifications to the configuration parameters of the first gaming machine to thereby improve the machine performance of the first gaming machine; and, automatically modifying, via the first gaming machine, at least one of the first gaming machine's configuration parameters based upon the results of the analysis.

Another aspect of this disclosure is directed to machine-readable storage media with instructions which, when executed by one or more processors resident to a gaming machine, cause the one or more processors to perform operations comprising: store on a memory device resident to the gaming machine, a first set of data indicative of configuration parameters of the gaming machine, and a second set of data indicative of machine performance of the gaming machine; receive from a peer gaming machine via a peer-to-peer gaming network a third set of data indicative of configuration parameters of the peer gaming machine, and a fourth set of data indicative of machine performance of the peer gaming machine; analyze the received data via at least one of the one or more processors resident to the gaming machine to determine if the machine performance of the peer gaming machine is better than the machine performance of the resident gaming machine; and, responsive to the results of the analysis, automatically modify at least one of the configuration parameters of the gaming machine based upon the configuration parameters of the peer gaming machine.

In accordance with yet another aspect, a gaming system for conducting a wagering game is featured. The gaming system includes a plurality of gaming machines, each of which has a respective display device, a respective memory device, and a respective communication interface. Each communication interface is configured to receive data and transmit data. Each of the gaming machines is configured to store data on their respective memory device. The gaming system includes a peer-to-peer network that communicatively couples the gaming machines together. Each gaming machine is operable to: (1) selectively transfer machine performance data and machine configuration data to the other gaming machines on the peer-to-peer network; (2) analyze data transferred thereto via the other gaming machines on the peer-to-peer network; and, (3) automatically modify one or more configuration parameters of the gaming machine based on the analyzed data transferred thereto via the other gaming machines on the peer-to-peer network.

The above summary is not intended to represent each embodiment or every aspect of the present disclosure. Rather, the summary merely provides an exemplification of some of the novel features presented herein. The above features and advantages, and other features and advantages of the present disclosure, will be readily apparent from the following detailed description of exemplary embodiments and modes for carrying out the present invention when taken in connection with the accompanying drawings and the appended claims.

Figure 1:
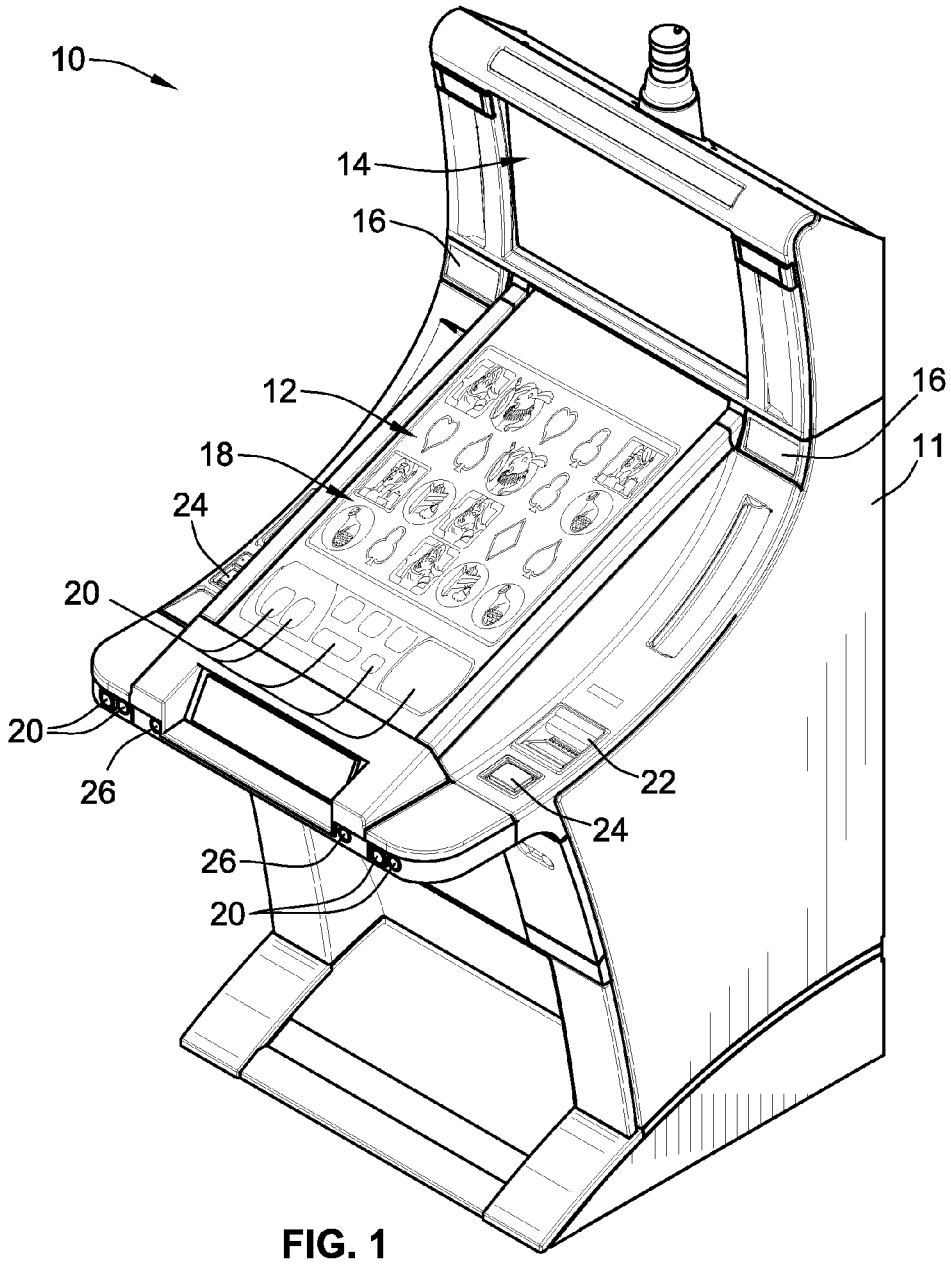
FIG. 1 is a perspective-view illustration of an exemplary free-standing gaming terminal according to aspects of the present disclosure.

While aspects of this disclosure are susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION

This invention is susceptible of embodiment in many different forms. There are shown in the drawings and will herein be described in detail representative embodiments of the invention with the understanding that the present disclosure is to be considered as an exemplification of the principles of the invention and is not intended to limit the broad aspects of the invention to the embodiments illustrated. To that extent, elements and limitations that are disclosed, for example, in the Abstract, Summary, and Detailed Description sections, but not explicitly set forth in the claims, should not be incorporated into the claims, singly or collectively, by implication, inference or otherwise. For purposes of the present detailed description, unless specifically disclaimed: the singular includes the plural and vice versa; the words "and" and "or" shall be both conjunctive and disjunctive; the word "all" means "any and all"; the word "any" means "any and all"; and the word "including" means "including without limitation." Moreover, words of approximation, such as "about," "almost," "substantially," "approximately," and the like, can be used herein in the sense of "at, near, or nearly at," or "within 3-5% of," or "within acceptable manufacturing tolerances," or any logical combination thereof, for example.

Referring to the drawings, wherein like reference numerals refer to like features throughout the several views, there is shown in FIG. 1 a representative gaming terminal 10 similar to those used in gaming establishments, such as casinos, hotels and cruise ships, and non-conventional gaming establishments, such as airports and restaurants. With regard to the present disclosure, the gaming terminal 10 (used herein interchangeably with "gaming machine" and "gaming device") may be any type of wagering game device and may have varying structures and methods of operation. For example, in some aspects, the gaming terminal 10 is an electromechanical gaming terminal configured to play slots with mechanical reels, whereas in other aspects, the gaming terminal is an electronic gaming terminal configured to play a video casino game, such as slots, keno, poker, blackjack, roulette, craps, etc. The gaming terminal 10 may take any suitable form, such as floor-standing models (as shown), handheld mobile devices, bartop models, workstation-type console models, personal computing devices, etc. Further, the gaming terminal 10 may be primarily dedicated for use in conducting wagering games, or may include non-dedicated devices, such as mobile phones, personal digital assistants, personal computers, etc. Exemplary types of gaming terminals are disclosed in U.S. Pat. No. 6,517,433, U.S. Patent Application Publication Nos. US2010/0069160 and 2010/0234099, and International Application No. PCT/US2007/000792, all of which are incorporated herein by reference in their respective entireties for all purposes.

The gaming terminal 10 illustrated in FIG. 1 comprises a cabinet 11 that may house various input devices, output devices, and input/output devices. By way of non-limiting example, the gaming terminal 10 includes a primary display area 12, a secondary display area 14, and one or more audio speakers 16. The primary display area 12 or the secondary display area 14 may be a mechanical-reel display, a video display, or a combination thereof in which a transmissive video display may be disposed in front of the mechanical-reel display to portray a video image superimposed upon the mechanical-reel display. The display areas may variously display information associated with wagering games, non-wagering games, community games, progressive games, advertisements, services, premium entertainment, text messaging, emails, alerts, announcements, broadcast information, subscription information, etc., appropriate to the particular mode(s) of operation of the gaming terminal 10. The gaming terminal 10 includes a touch screen(s) 18 mounted over the primary and/or secondary areas 12, 14, buttons 20 on a button panel, bill validator 22, information reader/writer(s) 24, and player-accessible port(s) 26 (e.g., audio output jack for headphones, video headset jack, USB port, wireless transmitter/receiver, etc.). It should be understood that numerous other peripheral devices and other elements exist and are readily utilizable in any number of combinations to create various forms of a gaming terminal in accord with the present concepts.

Input devices, such as the touch screen 18, buttons 20, a mouse, a joystick, a gesture-sensing device, a voice-recognition device, and a virtual input device, accept player input(s) and transform the player input(s) to electronic data signals indicative of the player input(s), which correspond to an enabled feature for such input(s) at a time of activation (e.g., pressing a "Max Bet" button or soft key to indicate a player's desire to place a maximum wager to play the wagering game). The input(s), once transformed into electronic data signals, are output to a CPU for processing. The electronic data signals can be selected from a group consisting essentially of an electrical current, an electrical voltage, an electrical charge, an optical signal, an optical element, a magnetic signal, and a magnetic element.

Figure 2:
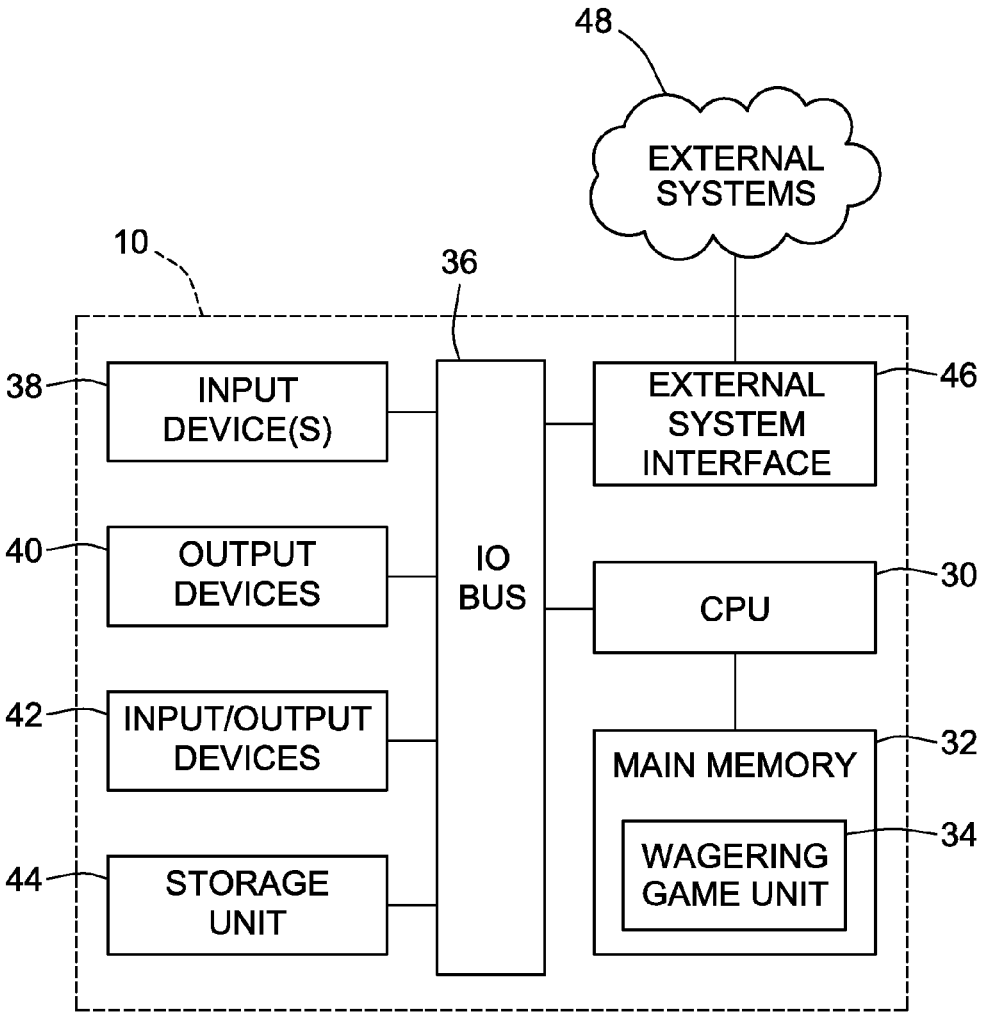
FIG. 2 is a schematic diagram of an example of a gaming system according to aspects of the present disclosure.

Turning now to FIG. 2, there is shown a block diagram of the gaming-terminal architecture. The gaming terminal 10 includes a central processing unit (CPU) 30 connected to a main memory 32. The CPU 30 may include any suitable processor(s), such as those made by Intel and AMD. By way of example, the CPU 30 includes a plurality of microprocessors including a master processor, a slave processor, and a secondary or parallel processor. CPU 30, as used herein, comprises any combination of hardware, software, or firmware disposed in or outside of the gaming terminal 10 that is configured to communicate with or control the transfer of data between the gaming terminal 10 and a bus, another computer, processor, device, service, or network. The CPU 30 comprises one or more controllers or processors and such one or more controllers or processors need not be disposed proximal to one another and may be located in different devices or in different locations. The CPU 30 is operable to execute all of the various gaming methods and other processes disclosed herein. The main memory 32 includes a wagering game unit 34. In one embodiment, the wagering game unit 34 may present wagering games, such as video poker, video black jack, video slots, video lottery, etc., in whole or part.

The CPU 30 is also connected to an input/output (I/O) bus 36, which can include any suitable bus technologies, such as an AGTL+ frontside bus and a PCI backside bus. The I/O bus 36 is connected to various input devices 38, output devices 40, and input/output devices 42 such as those discussed above in connection with FIG. 1. The I/O bus 36 is also connected to storage unit 44 and external system interface 46, which is connected to external system(s) 48 (e.g., wagering game networks). In some embodiments, storage unit 44 stores performance data and/or configuration data.

The external system 48 includes, in various aspects, a gaming network, other gaming terminals, a gaming server, a remote controller, communications hardware, or a variety of other interfaced systems or components, in any combination. In yet other aspects, the external system 48 may comprise a player's portable electronic device (e.g., cellular phone, electronic wallet, etc.) and the external system interface 46 is configured to facilitate wireless communication and data transfer between the portable electronic device and the CPU 30, such as by a near-field communication path operating via magnetic-field induction or a frequency-hopping spread spectrum RF signals (e.g., Bluetooth, etc.).

The gaming terminal 10 optionally communicates with the external system 48 such that the terminal operates as a thin, thick, or intermediate client. In general, a wagering game includes a random number generator (RNG) for generating a random number, game logic for determining the outcome based on the randomly generated number, and game assets (e.g., art, sound, etc.) for presenting the determined outcome to a player in an audio-visual manner. The RNG, game logic, and game assets are contained within the gaming terminal 10 ("thick client" gaming terminal), the external system 48 ("thin client" gaming terminal), or are distributed therebetween in any suitable manner ("intermediate client" gaming terminal).

The gaming terminal 10 may include additional peripheral devices or more than one of each component shown in FIG. 2. Any component of the gaming terminal architecture may include hardware, firmware, or tangible machine-readable storage media including instructions for performing the operations described herein. Machine-readable storage media includes any mechanism that stores information and provides the information in a form readable by a machine (e.g., gaming terminal, computer, etc.). For example, machine-readable storage media includes read only memory (ROM), random access memory (RAM), magnetic disk storage media, optical storage media, flash memory, etc.

Figure 3:
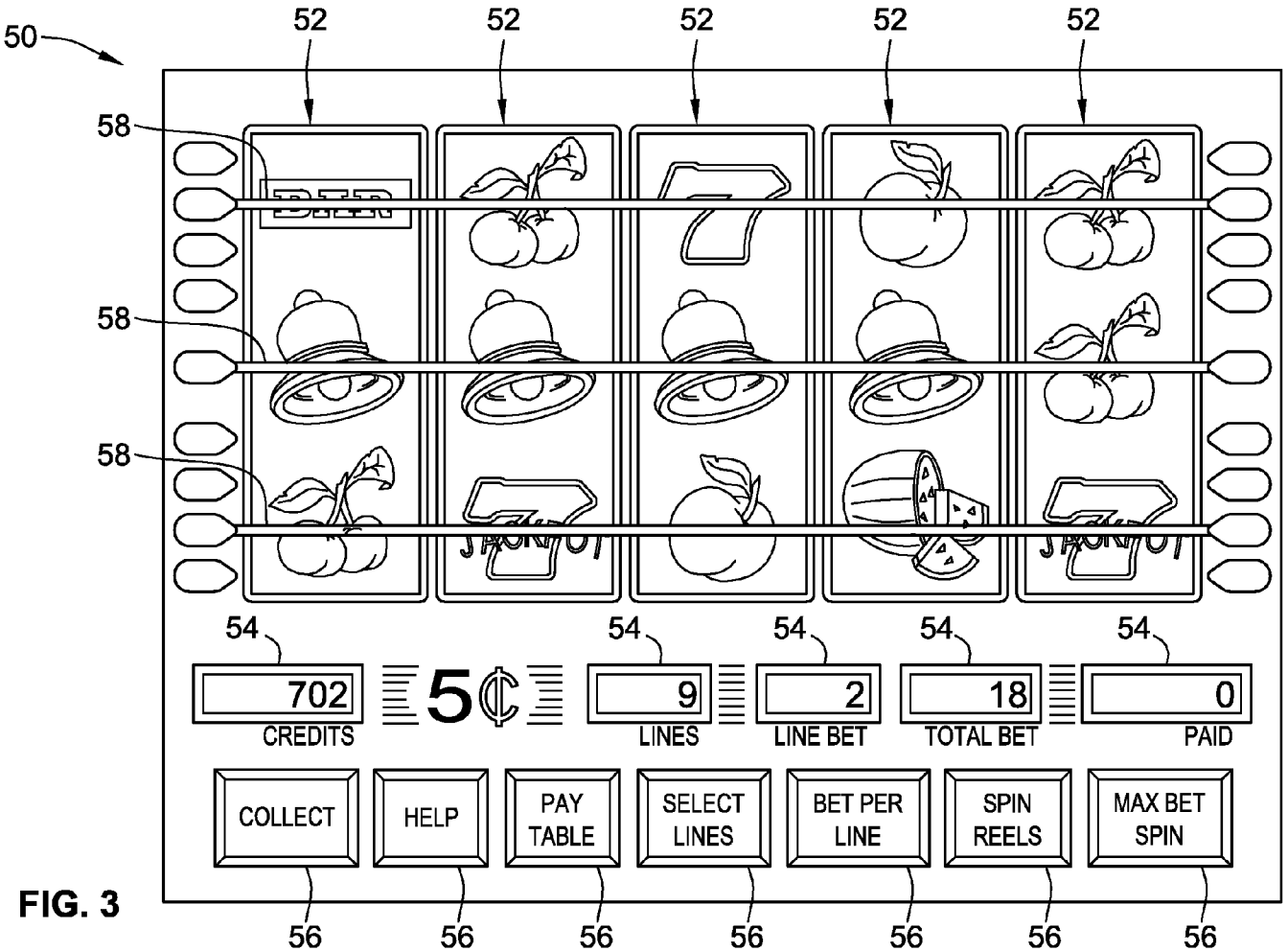
FIG. 3 is a screen shot of a representative basic-game screen of a wagering game displayed on a gaming terminal, gaming device, and/or gaming system according to aspects of the present disclosure.

Referring now to FIG. 3, there is illustrated an image of a basic-game screen 50 adapted to be displayed on the primary display area 12 or the secondary display area 14. The basic-game screen 50 portrays a plurality of simulated symbol-bearing reels 52. Alternatively or additionally, the basic-game screen 50 portrays a plurality of mechanical reels or other video or mechanical presentation consistent with the game format and theme. The basic-game screen 50 also advantageously displays one or more game-session credit meters 54 and various touch screen buttons 56 adapted to be actuated by a player. A player can operate or interact with the wagering game using these touch screen buttons or other input devices such as the buttons 20 shown in FIG. 1. The CPU operate(s) to execute a wagering game program causing the primary display area 12 or the secondary display area 14 to display the wagering game.

In response to receiving a wager, the reels 52 are rotated and stopped to place symbols on the reels in visual association with paylines such as paylines 58. The wagering game evaluates the displayed array of symbols on the stopped reels and provides immediate awards and bonus features in accordance with a pay table. The pay table may, for example, include "line pays" or "scatter pays." Line pays occur when a predetermined type and number of symbols appear along an activated payline, typically in a particular order such as left to right, right to left, top to bottom, bottom to top, etc. Scatter pays occur when a predetermined type and number of symbols appear anywhere in the displayed array without regard to position or paylines. Similarly, the wagering game may trigger bonus features based on one or more bonus triggering symbols appearing along an activated payline (i.e., "line trigger") or anywhere in the displayed array (i.e., "scatter trigger"). The wagering game may also provide mystery awards and features independent of the symbols appearing in the displayed array.

In accord with various methods of conducting a wagering game on a gaming system in accord with the present concepts, the wagering game includes a game sequence in which a player makes a wager and a wagering game outcome is provided or displayed in response to the wager being received or detected. The wagering game outcome is then revealed to the player in due course following initiation of the wagering game. The method comprises the acts of conducting the wagering game using a gaming apparatus, such as the gaming terminal 10 depicted in FIG. 1, following receipt of an input from the player to initiate the wagering game. The gaming terminal 10 then communicates the wagering game outcome to the player via one or more output devices (e.g., primary display 12 or secondary display 14) through the display of information such as, but not limited to, text, graphics, static images, moving images, etc., or any combination thereof. In accord with the method of conducting the wagering game, the CPU transforms a physical player input, such as a player's pressing of a "Spin Reels" touch key, into an electronic data signal indicative of an instruction relating to the wagering game (e.g., an electronic data signal bearing data on a wager amount).

In the aforementioned method, for each data signal, the CPU (e.g., CPU 30) is configured to process the electronic data signal, to interpret the data signal (e.g., data signals corresponding to a wager input), and to cause further actions associated with the interpretation of the signal in accord with computer instructions relating to such further actions executed by the controller. As one example, the CPU causes the recording of a digital representation of the wager in one or more storage media (e.g., storage unit 44), the CPU, in accord with associated computer instructions, causing the changing of a state of the storage media from a first state to a second state. This change in state is, for example, effected by changing a magnetization pattern on a magnetically coated surface of a magnetic storage media or changing a magnetic state of a ferromagnetic surface of a magneto-optical disc storage media, a change in state of transistors or capacitors in a volatile or a non-volatile semiconductor memory (e.g., DRAM), etc. The noted second state of the data storage media comprises storage in the storage media of data representing the electronic data signal from the CPU (e.g., the wager in the present example). As another example, the CPU further, in accord with the execution of the instructions relating to the wagering game, causes the primary display 12, other display device, or other output device (e.g., speakers, lights, communication device, etc.) to change from a first state to at least a second state, wherein the second state of the primary display comprises a visual representation of the physical player input (e.g., an acknowledgement to a player), information relating to the physical player input (e.g., an indication of the wager amount), a game sequence, an outcome of the game sequence, or any combination thereof, wherein the game sequence in accord with the present concepts comprises acts described herein. The aforementioned executing of computer instructions relating to the wagering game is further conducted in accord with a random outcome (e.g., determined by an RNG) that is used by the CPU to determine the outcome of the game sequence, using a game logic for determining the outcome based on the randomly generated number. In at least some aspects, the CPU is configured to determine an outcome of the game sequence at least partially in response to the random parameter.

Figure 4A:
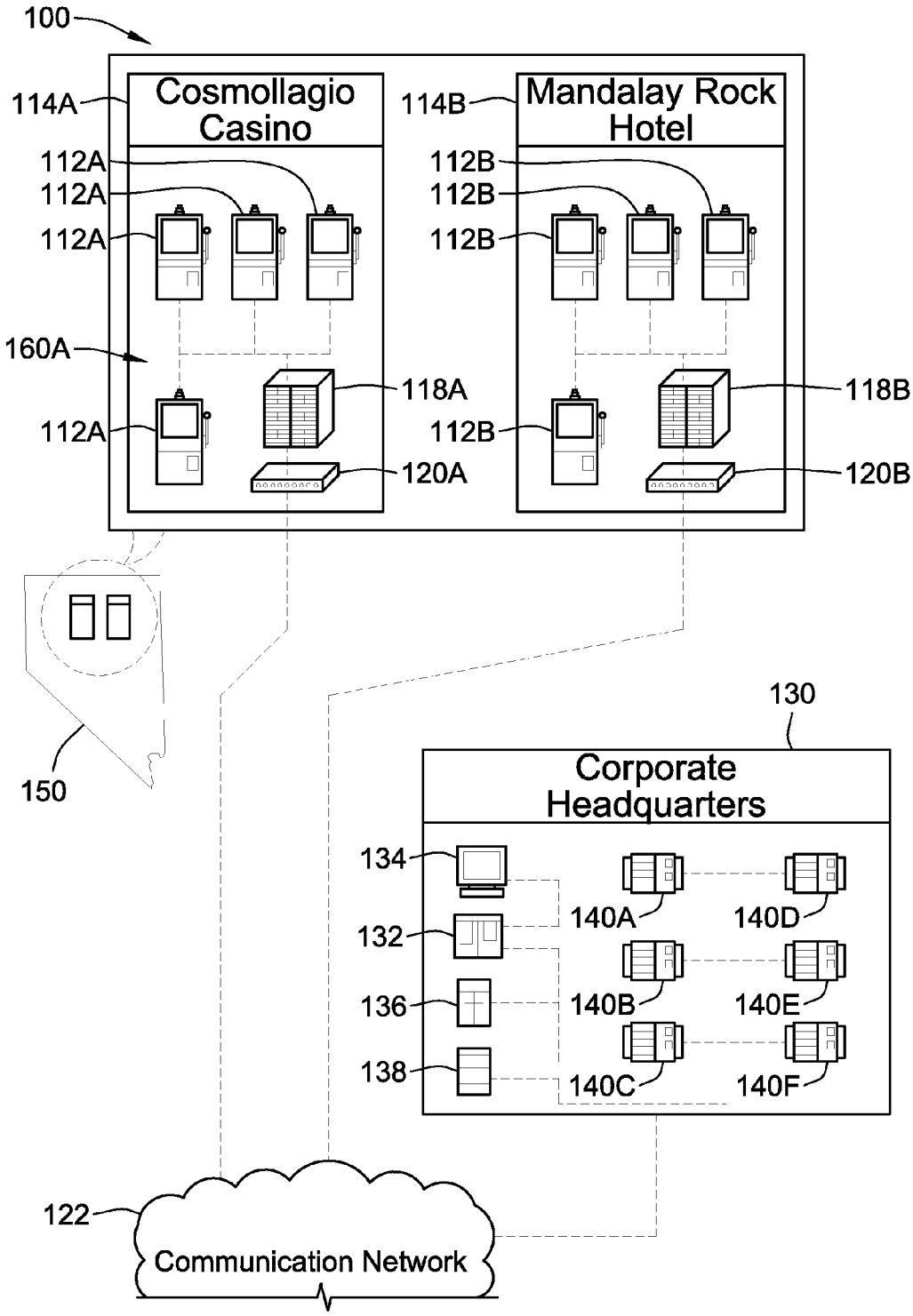
FIGS. 4A and 4B present a diagrammatic illustration of a representative gaming system and network in accordance with aspects of the present disclosure.
Figure 4B:
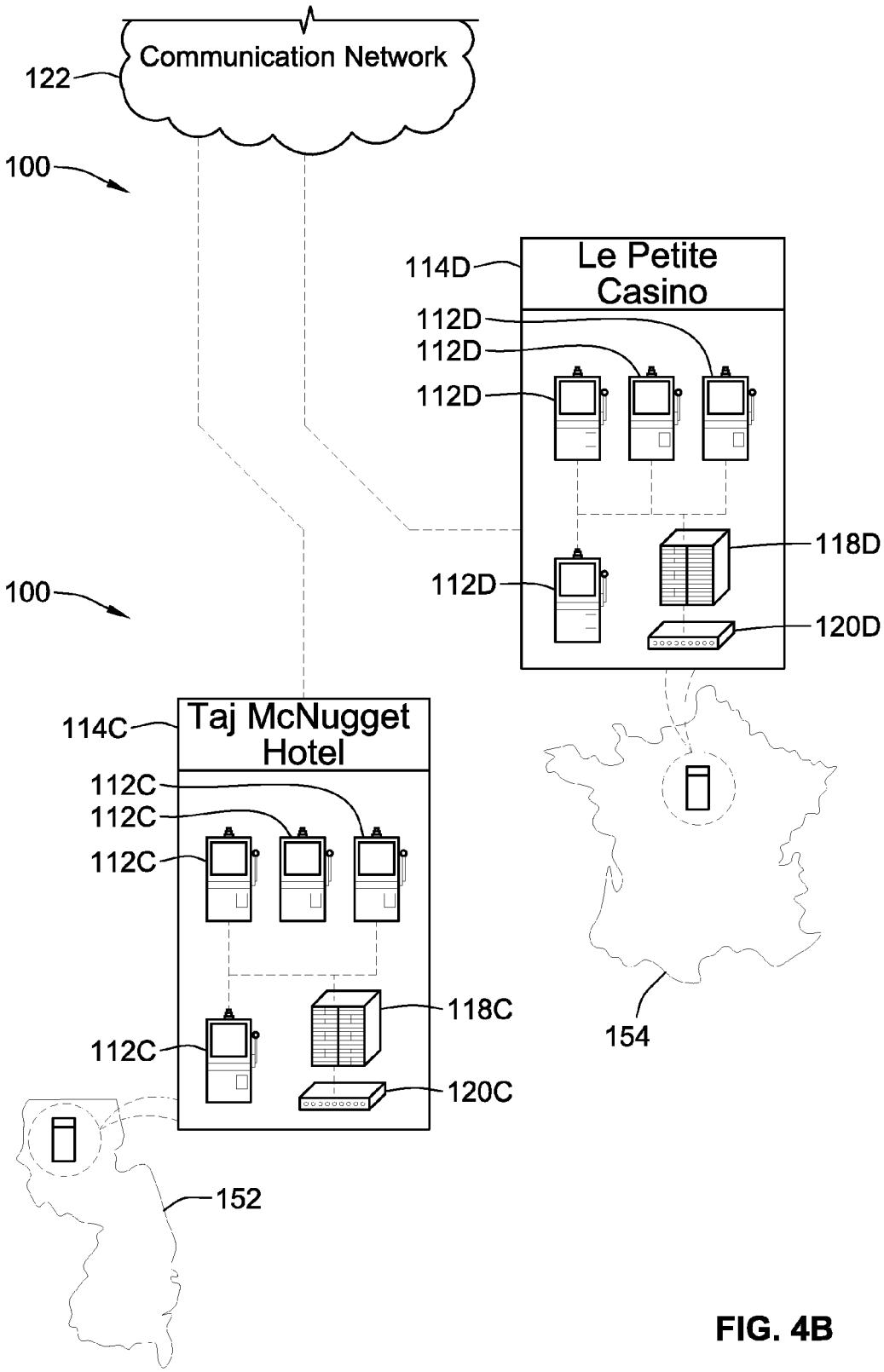

FIGS. 4A and 4B provide a diagrammatic illustration of a representative gaming system and network with which aspects of the disclosed concepts can be practiced. As shown, the gaming system and network 100 includes a first plurality of gaming terminals 112A located in a first "land-based" gaming establishment 114A (e.g., the "Cosmollagio Casino"), and a second plurality of gaming terminals 112B located in a second "land-based" gaming establishment 114B (e.g., the "Mandalay Rock Hotel"). In this regard, the gaming system and network 100 may also include a third plurality of gaming terminals 112C located in a third "land-based" gaming establishment 114C (e.g., the "Taj McNugget Hotel"), and a fourth plurality of gaming terminals 112D located in a fourth "land-based" gaming establishment 114D (e.g., the "Le Petite Casino"). According to the illustrated example, the first and second gaming establishments 114A, 114B are located in a first location 150 (e.g., the State of Nevada), whereas the third gaming establishment 114C is located in a second location 152 (e.g., the State of New Jersey), while the fourth gaming establishment 114D is located in a third location 154 (e.g., the Country of France). Each gaming establishment 114A-D utilizes a local "casino" server 118A, 118B, 118C and 118D, respectively, which is communicatively coupled to a corresponding communications hub 120A, 120B, 120C and 120D, respectively. The local servers 118A-D individually, collectively and/or in collaboration with an offsite central server system (not shown), can offer a plurality of wagering games in such categories as slots, poker, bingo, keno, and blackjack, just to name a few examples.

Although differing in appearance, the gaming terminals 112A-D can take on any of the various forms, optional configurations, and functional alternatives described herein and, thus, can be similar in function and connectivity to the gaming terminal 10 discussed above with respect to FIGS. 1 and 2. The gaming terminals 112A-D of FIGS. 4A and 4B can take on various other configurations, including free-standing gaming terminals, handheld mobile gaming devices, countertop gaming machines, personal computers or laptop computers, mobile computing devices, or any combination thereof. In this regard, the gaming establishments may be traditional gaming establishments, such as casinos and hotels, as well as non-traditional gaming establishments, such as pools, restaurants, cruise ships, and airports.

The gaming establishments 114A-D, including one or more of the gaming terminals 112A-D, are shown communicatively linked by a communications network 122. To facilitate such communications, the communications network 122 may include wireless communication links and/or wired communication links. The wired and wireless communication links can employ any suitable connection technology, such as Bluetooth, 802.11, Ethernet, public switched telephone networks, and SONET, as some non-limiting examples. In so doing, the servers 118A-D can exchange data and serve wagering games to devices located in other casinos or at other locations on the communications network 122. Similarly, the gaming system and network 100 can send and receive performance data and configuration data to devices located in other casinos or at other locations on the communications network 122.

The communications network 122 may be an intranet network based on TCP/IP (Transmission Control Protocol/Internet Protocol) protocols belonging to an organization, usually a corporation, accessible only by the organization's members, employees, and/or others with proper authorization. In the illustrated system, the intranet can be used to securely network the gaming terminals 112A-D to a local casino server 118A-D and other terminals, both inside and outside of their respective establishments 114A-D. Each of the local servers 118A-D can operate an intranet web site and post wagering games on a web site. The web site can include a firewall to fend off unauthorized access. With proper authorization, non-casino-based personal computing devices, such as personal computers and smartphones, may access the web page(s) via the internet and thereby link to the local casino servers 118A-D and even the gaming terminals 112A-D. Thus, in some embodiments, aspects of the present disclosure may be implemented in web, browser, html, flash, apps, and other similar applications. The communications network 122 can also be used for the individual gaming terminals 112A-D to transmit data and gaming features to each other.

When a wagering game is conducted via one of the gaming terminal 112A-D, the wagering game may be conducted at a server level, a terminal level, or a hybrid server/terminal level depending, for example, upon how the machine and the system are set up. When the wagering game is conducted at the server level, the game's audiovisual content and game software are executed, for example, at one of the local casino servers 118A-D. In this case, the gaming terminals 112A-D need not include a game engine for executing the game software and primarily serve as a display device. To allow the terminals 112A-D to execute the audiovisual content and game software, this information is downloaded from a local casino server 118A-D to the terminal 112A-D and stored locally prior for conducting the wagering game. When the wagering game is conducted at the hybrid level, the audiovisual content is executed at the terminal 112A-D while the game software is executed at the server 118A-D. To allow the terminal 112A-D to execute the audiovisual content, the audiovisual content is downloaded from the server 118A-118D and stored locally on the gaming device prior to conducting the wagering game. In order to make wagering games conducted via remote computing devices verifiable, it may be required that the random event be generated at the server 118A-D. Thus, in some embodiments, wagering games may not be conducted solely at the device level.

The gaming terminals 112A-D in each land-based gaming establishment 114A-D can be linked by a high-speed local area network (LAN), such as a wireless or wired Ethernet. Each local area network can be configured to support standard Internet protocols, such as TCP/IP, for transmitting data over the local area network and transmitting data between the local area network and a local system 118A-D. The local casino server 118A-D may include a gateway that serves as an entrance to the local area network. The gateway can be associated with a router, which knows where to direct a given packet of data that arrives at the gateway, and a switch, which furnishes the actual path in and out of the gateway for a given packet. The communications hub 120A-D can consolidate data transferred to and from the gaming terminals 112A-D. A workstation (not shown) may be used to program, control, and monitor the gaming terminals 112A-D at the local casino level.

In some embodiments, the gaming terminals 112A-D can also be networked to a corporate headquarters 130 by the communications network 122. The representative corporate headquarters 130 of FIG. 4A includes one or more corporate casino computers 134, one or more corporate casino servers 132, one or more trend analysis computers 136, one or more database managers 138, and various databases 140A-F. The corporate casino computer(s) 134 may be used to program, control, and/or monitor the gaming terminals 112A-D at the corporate level and view data accumulated in the various databases 140A-F. The corporate server(s) 132 is linked to the communications network 122 for transferring data to and from the network 122.

In some embodiments, the database manager 138 can manage data acquired by the corporate server 132 and can route the acquired data for storage in the appropriate databases 140A-F. The game library database 140A stores a plurality of wagering games. The corporate casino computer 134 may cause the database manager 138 to selectively access the wagering games in the game library database 140A and download the selected games to one or more local casino servers, gaming devices and/or a casino web server lob. The local casino servers may, in turn, download a portion or all of each selected game to some or all of the gaming terminals 112A-D in their respective casinos. The wagering games selected for download and the locations to where the games are downloaded may be based on trends established by running alternate regressions in the trend analysis computer 136. The financial accounting database 140B stores general financial accounting information.

The player account database 140C includes records or "house accounts," each of which has fields of information related to an individual player. The fields within each account may, for example, include name, date of birth, social security number, address, telephone number(s), credit card type, number and expiration date, and other requisite information. Additional optional fields may include player tracking information, player preferences, and server preferences. Based on the player tracking information, player preferences, and server preferences in a player's account, a central server system may adapt or configure the selectable games, the wagering games, the gaming devices, etc., based on the player.

The player tracking information may include such game play data as an identification of last ten machines played, titles of the games played, and jackpots and other prizes won by the player. For each denomination (e.g., nickel, dime, quarter, half-dollar, dollar, etc.), the game play data may include data fields for the number of credits played, the number of credits paid out, the number of games played, and the time of play in minutes. Of course, the amount and types of data stored in a player's account may be varied to suit a particular casino.

Server preferences can reflect certain parameters that the central server system can adjust according to certain criteria, such as skill level, wagering behavior, and/or operator preferences, to maintain the interest of its players, optimize profitability, etc. The server preferences may include hold percentage, complimentary award rate, complimentary award limits, game eligibility (lockout), and other information. Hold percentage indicates a range of hold percentages, such as high, medium, and low.

A progressive jackpot database 140D may, for example, track how many progressive jackpots are operating, where the progressive jackpots are operating, how much money is in each operating progressive jackpot, what progressive jackpots were paid out, and when the progressive jackpots were paid out. A slot accounting database 140E can include accounting meters for tracking credits in, credits out, credits played, credits won, games played, etc. for one or more of the wagering games. The accounting database 140E may also identify the gaming machine 12 or computing device 14 used to generate this data. These accounting meters can allow the trend analysis computer 136 to analyze the performance of each wagering game, each gaming location, individual gaming machines, groups of gaming machines, etc. The player marketing information database 140F can track, for example, the identities of players, which wagering games are being played the most/least, where the wagering games are being played, when each wagering game is being played (e.g., days/times), and how often and/or for how long each wagering game is being played. This information can, in turn, be used to assess player habits and behaviors. Fewer or additional databases may be incorporated into the corporate headquarters 130 than those identified above.

In networked game play, gaming machines, such as those exemplified in FIGS. 4A and 4B, have configuration parameters that may be customized or otherwise modified, for example, to meet the preferences and/or requirements of a specific gaming establishment, to establish communication protocols between a gaming device and a host computer or central gaming system or peer gaming device, to optimize machine performance, to exchange data, etc. When a gaming machine is first installed on the gaming floor, or at times throughout its operational life, both electromechanical and electronic gaming machines may require configuration or reconfiguration to communicate with the host computer system, to modify existing game settings, to enable new classes of games, game features and/or gaming functions, etc. For instance, the gaming machines 112A-D of FIGS. 4A and 4B can be in serial communication with at least one host computer, such as the corporate casino computer 134, through a serial poller in a master-slave communication protocol. Each gaming machine 112A-D, when first installed on the floor, may require configuration in order for the gaming machine to communicate with these host computers. With this arrangement, each serial poller can poll an individual gaming machine for data, and the gaming machine replies with the requested data. The host computer(s) can then gather information relating to a specific gaming function performance and/or feature from the gaming machine.

The gathered information may take on a variety of different types and combinations of data. In accordance with aspects of the present disclosure, the data may include player-performance data related to player wagering behavior. In this regard, the player-performance data may be based on a statistical analysis of player wagering behavior. This data may include one or more of the following:

- average ("expected") wager per play—e.g., the average (mean, median, mode, or combination thereof) of the total wager placed for each play of a wagering game, taken over a statistically significant population of plays across a plurality of gaming machines
- average ("expected") bankroll—e.g., the average (mean, median, mode, or combination thereof) of the total money tendered by a player and expended during a single gaming session (e.g., from when the player sits down at a gaming machine and/or initiates initiate a first play of the wagering game until they complete a final play of the wagering game and/or standup to leave the gaming machine), taken over a statistically significant population of plays across a plurality of gaming machines
- average ("expected") time on device—e.g., the average (mean, median, mode, or combination thereof) of the total time expended and/or the total number of plays completed during a single gaming session (e.g., from when the player sits down at a gaming machine and/or initiates a first play of the wagering game until they complete a final play of the wagering game and/or standup to leave the gaming machine), taken over a statistically significant population of plays across a plurality of gaming machines In statistics and probability theory, the median is described as the numerical value separating the higher half of a sample, population, or probability distribution, from the lower half. The median of a finite list of numbers can be found by arranging all the observations from lowest value to highest value and selecting the middle value. The median helps to eliminate/reduce the effects of outliers that may otherwise skew the average value.

The gathered information may also include machine performance information comprising data regarding the operation of a wagering game machine. Various combinations and types of data may be stored as machine performance data. In accordance with aspects of the present disclosure, machine performance data may include a statistical analysis of a gaming machine's monetary input, monetary output, overall use, and/or other metrics relevant to the performance (or "yield") of a machine or group of machines. It is desirable, in at least some embodiments, that the statistical analysis be conducted over a statistically significant sample period. The machine performance data may include one or more of the following:

- coin in data—the monetary value input into the wagering game machine to purchase game play (e.g., total money taken in by an individual gaming machine during a sample period)
- payout data—coin in value multiplied by the hold percentage, where the hold percentage comprises the percentage of coin in held by the casino (e.g., 100%— payback percentage), or coin in value multiplied by the payback percentage over a sample period
- occupancy data—the percentage of time the wagering game machine is occupied (e.g., percentage of time over a sample period—a day, a week, a month, etc.—that an individual gaming machine is in use)

The data may be associated with time data, such as a period of time during which the data was collected. Those of skill in the art will appreciate that other types of data may be maintained and such data is within the scope of this disclosure.

Other exchanged information may include data related to the various configuration parameters that affect the operation of a wagering game machine or the wagering game(s) presented on the wagering game machine. Examples of such configuration parameters may include one or more of the following:

- line count—e.g., the number of lines of symbols to be displayed by a wagering game machine or the number of displayed reel symbols that indicates an outcome of a play of a wagering game
- available paylines—e.g., the number of paylines in a matrix of symbols that may be wagered on and used to determine a winning combination of symbols; a paylines may be straight, horizontal, vertical, diagonal, or may take an arbitrarily defined path through the displayed reel symbols
- denomination(s)—e.g., the minimum amount of money/credits required for a single wager in a single game play (1 cent, 5 cents, 10 cents, 25 cents, 1 dollar, etc.)
- pay tables—e.g., predefined tables that determine the award ("payout") associated with the occurrence of various combinations of symbols, cards, dice, numbers, etc., during play of a wagering game; in a slot machine, a pay table typically shows, for each combination of symbols and the number of coins bet, how many coins the bettor will win
- max bet—e.g., the maximum wager amount available for gambling during any single play of a wagering game
- min bet—e.g., the minimum wager amount available for gambling during any single play of a wagering game
- themes—e.g., images, audio, and video content portraying a theme for a wagering game/gaming machine
- bonus games—e.g., content, including software, audio, image, and video content, that provides a bonus round when triggered during play of a wagering game
- episodic content—e.g., content associated with episodes of a bonus round or wagering game
- attract content—e.g., content (images, audio, video, etc.) presented when the wagering game machine is idle (i.e., in "attract" mode) to attempt to attract players to the machine.
- progressive game—e.g., identification and associated information regarding which, if any, progressive game (s) the wagering game machine participates in
- play mechanics—e.g., aspects of how the wagering game may be played or presented, such as wager button configuration, payline button configuration, cascading reels, free spins, line combinations and other aspects of a wagering game play The above are examples of configuration parameters that may be maintained by a wagering game machine. Those of skill in the art will appreciate that other types of configuration data may be maintained and such configuration data is within the scope of this disclosure. In the same vein, each gaming machine may be operable to collect, store and/or exchange other types of information, such as internal and external sound characteristics, internal and external light characteristics, internal and external temperature characteristics, button pressures, and other internal and external environmental measurements.

As noted above, wagering game machines 112A-D may store and maintain various types of information, including those types discussed in the preceding paragraphs. This data may be periodically sent to a host system or central gaming system (e.g., corporate headquarters 130) for use in generating configuration settings/parameters for the wagering game machines. In some embodiments, the data received from one or more wagering game machines may be stored in one or more databases, such as databases 140A-F. A configuration analysis component, such as casino computers 134 and/or trend analysis computers 136, can analyze the data from the database(s) and apply rules defined in a rule set to determine new configuration parameters to be applied to one or more wagering game machines based on the data and the rule set. By way of non-limiting example, the rule set may be defined such that wagering game machines that perform in the lowest 20% when compared to other wagering game machines are automatically reconfigured. For instance, wagering game machines performing in the bottom 20% are reconfigured with configurations similar wagering game machines performing in the upper 20. Many other types of rules and combinations of rules are possible and within the scope of the inventive subject matter, as will be developed in further detail below.

Rules related to machine performance may vary depending, for example, on the goals of the gaming establishment. If revenue maximization is a goal, then the rules related to determining machine performance may use coin-in as a base or primary measurement of performance. Alternatively, if the casino wants to maximize occupancy in the short term in order to hopefully realize more revenue in the long term, then rules based on occupancy data may be used in determining performance of a wagering game machine. Similarly, rules associated with machine configurations may vary depending on the goals of the casino. If revenue maximization is a goal, for example, configurations designed to generate more revenue may be employed. Likewise, if maximizing occupancy is a goal, then configurations designed to provide maximum occupancy may be employed.

A rule set may be designed to take into account various factors when determining a configuration for one or more wagering game machines. For example, the rules may be defined such that a particular mix of themes, denominations, and/or wagering game types should be maintained, perhaps in order to attempt to maximize occupancy and coin in, and thus maximize revenue. Further, the rules may take into account pairings of particular bonus rounds and particular wagering games, pairings of wagering games or other combinations of bonus rounds, themes, episodes, and wagering games that may result in increased revenue and/or occupancy.

In some embodiments, one or more of the databases 140A-F maintains location data for each of the wagering game machines. This location data may then be used by a configuration analysis component, such as casino computers 134 and/or trend analysis computers 136, to determine the themes, denominations, line counts, paylines, max bet, min bet, hold percentage, and/or wagering game types that should be configured for wagering game machines in particular locations. Using location in determining a desired configuration may be preferable because it may be beneficial to locate certain themes, denominations and/or wagering game machine types in particular locations. For example, it may be desirable to locate games having a similar theme in one location. Further, it may be desirable to locate machines with particular denominations together and/or in a particular location in a casino. Further, it may be desirable to achieve a particular distribution of themes, denominations or wagering game types across a casino floor. As will be developed in further detail below, location data may also include geographic location, such as a city, state, country, or region of a country. It may be desirable to include such location data because wagering patterns may be different in different areas of a country or in different countries of the world.

Rules may also be time based. For example, it may be desirable to create configurations based on a time of day, day of week, time of year, or for special events that occur from time to time. For example, it may be desirable to reconfigure denominations based on time of day, with lower denominations used during the daytime and/or during weekdays, and higher denominations used at night time and/or during weekends. Similarly, certain events may make it desirable to adjust denominations, paylines, pay tables or other configuration parameters. By way of example, and not limitation, if a major boxing match is to occur on particular date, it may be desirable to configure wagering game machines with higher denominations, higher maximum bets, and/or higher line counts on the assumption that players that attend major boxing matches may also be willing to wager larger amounts.

Configuration analysis may also take configuration costs into account in determining a configuration or recommended configuration. Some configuration changes may be made at little or no cost to a gaming establishment, while other configuration changes may come with a relatively high cost. For example, configuration changes to paylines, max/min wager amounts, or average payout (i.e., payback percentage) may be made at relatively little cost, while a configuration change that requires a new game, new bonus round, or new episodic content may cost significant amounts of money to make (e.g. game cost, licensing fees etc.). Thus, the configuration analysis component of some embodiments may measure the cost of a configuration change when determining what, if any, configuration changes may be used to improve the performance of one or more wagering game machines.

Configuration analysis may run in a number of different ways. In some preferred implementations, a configuration analysis component may run continuously or automatically at particular times to reanalyze and generate new configurations based on currently available performance data. The new configurations may then be automatically sent to one or more wagering game machines. Alternatively, the configuration analysis component may generate an alert message that may be sent to a casino operator alerting the operator that a new configuration has been generated. The operator may then review the configuration and confirm or modify the configuration before the configuration is sent to the wagering game machine(s).

Optionally, configuration analysis may be run in response to an operator or technician initiating a configuration analysis component. Upon initiation, the configuration analysis component may analyze the available data and generate new recommended configurations for one or more wagering game machines. The configuration analysis component may then automatically initiate the new configuration, or may display a suggested configuration and allow for modification and/or confirmation via a user interface before automatically sending the configuration to one or more wagering game machines.

A rule set may be implemented as a set of heuristics that are encoded as instructions in a configuration analysis component. Heuristics refers to experience-based techniques for problem solving, learning, and discovery. Where an exhaustive search is impractical, heuristic methods are used to speed up the process of finding a satisfactory solution (e.g., the best approximate result). In some embodiments, the rule set may be defined in a rules definition language that may be input or edited, e.g., via a user interface. In further embodiments, rules sets may include rules that are discovered or defined with the assistance of a relationship discovery process. Examples of such processes can include neural networks, cluster analysis, statistical analysis, artificial intelligence methods, or other analysis methods designed to discover relationships in data. Further details on such analysis methodologies and systems may be found in U.S. Patent Application Publication No. 2004/0166940 A1, to Wayne H. Rothschild, which is incorporated herein by reference in its entirety and for all purposes.

Additional information regarding the configuration of wagering game machines can be found, for example, in commonly owned U.S. Pat. No. 8,142,291 B2, to Chad A. Ryan, commonly owned U.S. Pat. No. 7,641,555 B2, to Edward A. McKinley et al., commonly owned U.S. Pat. No. 6,749,510 B2, to John J. Giobbi, and commonly owned U.S. patent application Ser. No. 12/438,239 (corresponding to U.S. Patent Application Publication No. 2010/0234097 A1), to Phil Gelber et al., all of which are incorporated herein by reference in their respective entireties and for all purposes.

Figure 5:
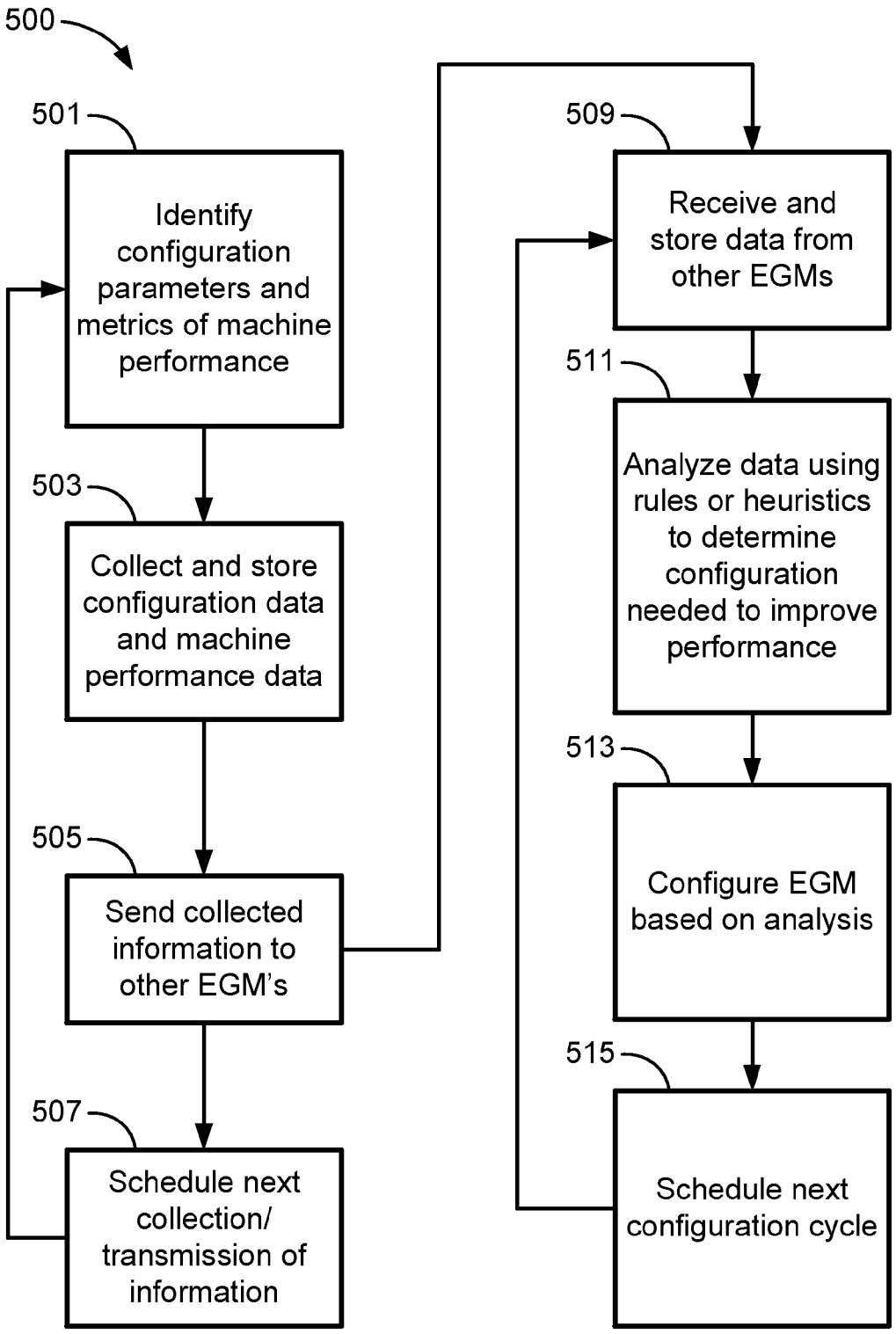
FIG. 5 is a flowchart for an exemplary method or algorithm that can correspond to instructions that can be stored on one or more non-transitory computer-readable media and can be executed by one or more controllers in accord with aspects of the disclosed concepts.

With reference now to the flow chart of FIG. 5, an improved method for configuring one or more gaming devices in a gaming system, such as the gaming devices and systems shown in FIGS. 1, 2, 4A and 4B, for example, is generally described at 500 in accordance with aspects of the present disclosure. FIG. 5 can be representative of an algorithm that corresponds to at least some instructions that can be stored, for example, in main memory 32 of FIG. 2, and executed, for example, by the CPU 30 and/or external system(s) 48 of FIG. 2 to perform any or all of the above or below described functions associated with the disclosed concepts. The method 500 will be described with reference to the various aspects and features shown in the drawings; such reference is being provided purely by way of explanation and clarification. It is desirable for some of the disclosed implementations that the method 500 be carried out by a single gaming machine without requiring external intervention, for example, from a central gaming computer system or a technician.

In some embodiments, the flow chart of FIG. 5 is representative of a method for configuring networked wagering game devices based on shared data. By way of example, a number of gaming devices, such as gaming terminals 112A of FIG. 4A, may be communicatively coupled together via a peer-to-peer gaming network, indicated generally at 160A in FIG. 4A, for sharing various types of information about gaming device configuration, performance, improvement, and optimization. According to some of the disclosed concepts, each gaming device is operable to use information related to their location, circumstances, and experiences to maximize yield and services. This maximization is done, in at least some implementations, without tracking player behavior or patron position. The networked "peer" gaming devices can share the positive-yield configuration settings for their physical locations and circumstances (e.g., game themes, time on device, play rate, coin in, etc.). These gaming devices can then use this collective knowledge to configure or reconfigure themselves for maximum yield and services.

A peer-to-peer (P2P) network is often characterized as a distributed application architecture that partitions tasks, responsibilities, and/or workloads between the various devices connected to the network, known as "peers" or "P2P nodes." A P2P network generally allows shared access to files and peripherals without the need for a central server. Each peer device typically makes a portion of its resources, such as processing power, stored information, disk storage, or network bandwidth, directly available to other network participants, without the need for central coordination or management by servers or hosts. In contrast to a traditional client-server model where servers supply and clients consume, peers are both suppliers and consumers of resources. For some implementations, each device on the P2P network 160 is operable to: (1) selectively transfer machine performance data and machine configuration data to the other gaming machines on the P2P network; (2) analyze the data transferred thereto via the other gaming machines on the peer-to-peer network; and (3) automatically modify one or more configuration parameters of the gaming machine based on the analyzed data transferred thereto via the other gaming machines on the P2P network. A detailed discussion of peer-to-peer networks is provided by Rüdiger Schollmeier in "A Definition of Peer-to-Peer Networking for the Classification of Peer-to-Peer Architectures and Applications," Proceedings of the First International Conference on Peer-to-Peer Computing, IEEE (2002), which is incorporated herein by reference in its entirety.

With a peer-to-peer network as described above, the gaming devices can advise, assist and/or control the configuration of a new or underperforming peer gaming device to improve machine performance. It is desirable, in at least some embodiments, for this configuration/reconfiguration process to be conducted in real time and, for some embodiments, be based on the location, corresponding environment and related circumstances of the gaming machine using the collective knowledge available from the networked gaming devices. This distributed intelligence generally does not require third party centralization or manual intervention. Advantageously, no patron or player knowledge of the configuration process is required, but may be made available if so desired. In a sense, the networked gaming devices can be made "aware" at both an individual level and at a group level of the other networked EGM's, as well as their respective locations, circumstances, configurations, performance, etc. Dynamically, the collective network of peer EGM's can determine the best EGM settings and behaviors for specific locations and/or specific circumstances. This database of knowledge comes from the deployed EGM's and, if desired, can be supplemented by external references, such as a central gaming server system or a third party vendor. This collection of information can be logged ("historical") or amassed in real time, or both, and can be adaptive to accommodate everchanging arrangements of gaming devices, available gaming features, new peripheral devices, new locations, and/or other circumstances.

As an example, a new gaming device can be placed anywhere on the gaming floor of a casino; by querying neighboring gaming devices already on the casino floor for their collective histories, locations and configuration settings, the new EGM can set the values for its configuration parameters to optimize machine performance. From the knowledge provided by neighboring EGM's, the new EGM can start up on the gaming floor and configure itself with game theme selections, theme configurations, mandatory jurisdictional and property settings, and time based behaviors that will help to maximize machine performance. As another example, an existing and underperforming EGM may be directed by the collective knowledge of its neighboring EGM's to adopt new configuration parameters to improve machine performance and maximize yield. In yet another example, the configuration parameters of multiple EGM's, including their available game theme sets and display settings, can be modified in accordance with the "local intelligence" offered by their peer EGM's to "follow the sun" and vary machine behavior with the change in position of the sun (or other time-based schedule) to maximize player engagement. For any of these examples, the configuration process can occur dynamically, automatically, and/or constantly (e.g., 24 hours a day, 7 days a week, 365 days a year) without intervention or central authority.

At block 501, the configuration process begins. In the illustrated example, the method 500 starts by first identifying one or more configuration parameters and one or more metrics of machine performance of the subject gaming machine and/or the group of networked gaming machines. This determination can be made on an individual basis at the terminal level, on a group basis at the peer-to-peer network level, or a combination thereof, which may me made independently of (or, alternatively, with direct involvement from) the client or a host system. The machine performance information and configuration parameter information can include any of the examples disclosed herein. For the configuration parameter data, this may include pay tables, denominations, and game themes, whereas the machine performance data may include coin in data, payout data, and time on device data, as some non-limiting examples. Other potentially relevant information may also be identified at this juncture, including location information, environmental information, jurisdictional information, client-specific information, etc. For at least some of the disclosed embodiments, the configuration parameters identified in block 501 are directly related to and, optionally, directly affect machine performance. In this regard, the configuration parameter(s) typically affect the mathematical configuration of the wagering games available on the subject gaming machine.

During block 503 of the method 500, the subject gaming machine begins collecting and, optionally, storing configuration data and machine performance data. This may include storing on one or more resident memory devices (e.g., main memory 32 of FIG. 2) a first set of data with information that is indicative of the subject gaming machine's configuration settings, and a second set of data with information that is indicative of the gaming machine's performance. Additional sets of data may also be collected and stored to cover such information as location information, environmental information, jurisdictional information, and/or client-specific information. As used herein, the numbered data sets are not necessarily intended to connote disparate, mutually exclusive sets of data that must be stored as separate files or stored at separate times or stored in separate locations. Rather, in some implementations, the various data sets described herein can be contemporaneously stored—singly, collectively and in different combinations—as a single data file on a single memory device. In some embodiments, all of the individual EGM's store system configuration and performance information, whereby this localized information enables more simplified and expeditious device configuration and logged data at the device level. A peer-to-peer configuration scheme of this nature can be employed such that the peer EGM's can coordinate amongst themselves how to configure each of the devices on the peer-to-peer network without the management of a master or central server. Alternatively, data can be collected locally by a gaming device and stored remotely from the gaming device.

Once this information is collected and, in some embodiments, stored locally on the subject gaming device, the method 500 then includes sending the information to one or more peer EGM's at block 505. Information will typically be transferred to all of the EGM's on the peer-to-peer network, or at least those within a predefined vicinity and/or with a minimum amount of available storage capacity, and will typically include at least the data sets with information representative of machine configuration and performance data. By way of example, a first "peer" gaming machine will transfer first and second sets of data to a second "peer" gaming machine via the peer-to-peer gaming network, while the second "peer" gaming machine transfers third and fourth sets of data to the first "peer" gaming machine. The transferred and stored information may likewise include, for example, commissioning and configuration information, such as communication setup (e.g., communication protocols, baud rates, transmit delays, unit ID's for networks, etc.), security controls (e.g., passwords, timesync sources, web and firewall access, etc.), database and network & server configurations (e.g., IP Address, Subnet mask, Gateway, DNS, etc.), device names, format setups (e.g., display options for values and dates), one-line-diagram information, and other general setup options. Additionally, during the commissioning process, other information, such as location information, regulatory information, as well as customer or anecdotal information related to that specific setup can be included.

There are a variety of manners in which data can be packaged and sent, as well as searched. For example, a master/slave approach can be used to exchange data, where one member of the P2P network is designated the master and the other members are designated as slaves. In another example, a peer-to-peer approach can be used, as described above. A hybrid of the two is also a conceivably viable option (e.g., the networked devices are broken up into peer clusters, each of which has a dedicated master). Performance and configuration information can be packaged much like a file or piece of data. By way of illustration, every data packet can contain at least a device ID (e.g., make, model, serial number), where the device is located in the system, characteristics of that device's location, what type(s) of configuration and performance information is provided by the device, other relevant information, or any combination thereof. During reconfiguration when a new device is added to the system, the new device may require at least a device ID so it can request (or wait to be pushed) the necessary data.

An assortment of options is also available for managing the collection and storage of information, such as a first-in-first-out (FIFO) method. In one implementation, the FIFO method entails deleting older data and/or moving older data to a distributed storage device (e.g., databases 140A-F at a central gaming system 130 in FIG. 4A), and then replacing the older data with new data. In some implementations, the first data transferred to and stored on a network peer will be the first data to be removed from the network peer to make room for more recently transferred information. Another available option would be a fill and hold (FAH) method. The FAH method may entail retaining all collected and stored data and, when storage capacity becomes limited on a particular device, automatically routing new data to another device with available memory. For some configurations, for example, one or more designated EGM's sends information to a central server or host computer, and that server/host stores the information in a remote location. In some implementations, the server/host can communicate this information back to one or more of the peer EGM's. This provides a failsafe in case one or more of the EGM's crashes. Hybrid variations of a FIFO and a FAH method are also known and similarly applicable. Other methods of data storage, such as the last in, first out (LIFO) method, can also be employed without departing from the intended scope and spirit of the present disclosure.

At block 507, the next cycle for collection and transmission of information may optionally be scheduled. This scheduling can be time driven (e.g., next cycle to occur in 10 business days) or event driven (e.g., responsive to the addition of a new gaming machine to the P2P network). Optionally, the scheduling may be continuous or semi-continuous or, alternatively, may be cyclical (e.g., once every day, week, or month). In this instance, block 507 may optionally be omitted from the method 500 of FIG. 5. For some implementations, information may be collected and transferred responsive to a request for information, for example, from a peer device, a master device, a central or host system, or an operator request.

Information collected by and transmitted from other peer gaming device(s) are received by a subject gaming device and, optionally, stored by the gaming device at block 509. This may include, for example, receiving from one or more peer gaming machines via the peer-to-peer gaming network, a third data set with information that is indicative of the configuration parameters of the peer gaming machine(s), and a fourth data set with information that is indicative of the performance of the peer gaming machine(s). The received data sets may subsequently be stored locally on one or more memory devices resident to the subject gaming machine. Optionally, each EGM could maintain a "publicly accessible" database of the aforementioned information, and make this database readily available such that other machines on the P2P network can selectively query that database for subsequent analysis and/or comparison. Such a configuration can eliminate the need for the receiving EGM to store peer data locally.

At block 511, the method 500 will analyze the data received from the peer EGM's. The data may be analyzed, for example, via one or more processors resident to the subject gaming machine to determine if the machine performance of the peer gaming machine(s) is better than the machine performance of the subject gaming machine. For example, if the coin in and/or occupancy of the peer gaming machine(s) is better than that of the subject gaming device, it is likely that the subject gaming device is misconfigured and, thus, requires reconfiguration. Conversely, if the subject gaming device is outperforming its peers, one or more of the peer EGM's may need to be reconfigured to improve the performance thereof. In this regard, the third and fourth data sets, which are indicative of the peer gaming machine's(s') configuration and performance, may be analyzed to identify one or more potential modifications to the configuration parameters of the subject gaming machine that will improve the subject gaming machine's performance. Continuing with the above example, if the coin in and occupancy of the peer gaming machine(s) are higher than that of the subject gaming device, it can be determined that the available game themes, denominations and/or other configuration settings of the subject EGM are not in tune with the player's patronizing that location and should be changed to more closely reflect the game themes and denominations available on the peer EGM's.

Analyzing the data sets will typically be based on a predefined rule set, which may define desired ranges and other restrictions which regulate the configuration of the gaming device. In this regard, the rule set may include restrictions and directives set forth in local gaming regulations or any of the other constraints and controls discussed hereinabove. The rule sets may be created, modified, or adjusted by an operator or other authorized user of the gaming system.

The analysis of the data sets received from the peer EGM's can also be based, at least in part, on a common location shared by the subject gaming machine and its peer gaming machines. For example, the analysis may be limited to data collected by peer gaming machines that are within a predefined vicinity of the subject gaming device. If the subject gaming device is located in the Midwest of the United States, for example, the analysis can be limited to similarly situated gaming machines. This may be desirable since it is known that the Midwest typically has a relatively low average wager per play and analyzing data indicative of wager-related machine configurations and coin in for EGM's located outside the Midwest may generate skewed results. In contrast, if the gaming device is located in the Northeast or on the West Coast of the United States, you may want to limit the analysis to gaming machines that are also located within the Northeast or on the West Coast. This is so because these EGM's will likely be configured with higher bet options since those regions are known to typically have a higher relative average wager per play. Similar rules may be applied on a more granular scale, such as limiting the analysis to peer devices located within the same bank or the same room of a gaming establishment, a more localized scale, such as limiting the analysis to devices located within the same casino, the same neighborhood, the same city, etc., or even on an international scale, such as limiting the analysis to devices located within the same country (e.g., U.S. vs. Australia vs. France, etc.).

The method 500 then includes modifying one or more configuration parameters of the subject gaming machine based upon the results of the analysis, as indicated at block 513. By way of example, in response to a determination that the performance of the peer gaming machine's(s') is better than the performance of the subject gaming machine, at least one of the configuration parameters of the subject gaming machine is automatically modified based, at least in part, upon the configuration parameters of the peer gaming machine(s). By way of illustration, and not limitation, if the coin in and occupancy of the peer gaming machine(s) are higher than that of the subject gaming device, it can be determined that the configuration parameter values for the pay tables, available wagering options (e.g., min bet, max bet, denominations, etc.), and/or other configuration settings of the subject EGM should be incrementally changed to more closely reflect the values for the wagering options and pay tables available on the peer EGM's. Contrastingly, if the subject gaming device is outperforming its peers—e.g., the coin in and occupancy of the peer gaming machine(s) are lower than that of the subject gaming device—one or more of the peer EGM's may need to be reconfigured to improve the performance thereof. In this instance, the subject gaming device may transmit to the underperforming peer gaming machine(s) a recommended modification to one or more of the peer gaming machine's configuration parameters to thereby improve the machine performance of the peer gaming machine(s).

At block 515 of FIG. 5, the next analysis and configuration cycle for the gaming machine may optionally be scheduled. Similar to block 507, the scheduling set forth in block 515 can be time driven or event driven. Optionally, the scheduling may be continuous or semi-continuous (e.g., in real time) or, alternatively, may be cyclical. For some implementations, analysis and configuration may be conducted responsive to receipt of a configuration request, for example, from a technician or a peer EGM. It may be desirable for some implementations that the analysis and configuration cycle be conducted when there are no players using the subject gaming machine. Alternatively, the player may be provided with an option to accept the analysis and configuration cycle; the player may then approve and initiate the cycle by entering an input to enable the analysis and configuration cycle.

At the end of the configuration process, a verification process may be initiated to verify that the gaming machine has been configured correctly. One method for doing this is to monitor the EGM to ensure that the CPU correctly responds to each of the configuration signals. This may include, for example, validating that the reconfiguration results in a positive change (e.g., improved machine performance and increased yield). The validation process may require a threshold validation period, such as a minimum amount of time or a minimum number of plays, to offset periods of infrequent use. In many jurisdictions only certain configuration parameters might be acceptable. Consequently, the gaming machine may be designed to verify that the configuration parameters requested are allowable in the jurisdiction where that machine is located. If they are not allowable, the configuration may be rejected without changing the gaming machine configuration parameters. A verification ticket may be printed that will indicate that the configuration has not been accepted and the configuration parameters have not been changed.

The method 500 may also incorporate a safety feature to ensure that networked gaming machines are not constantly in flux. For example, a safety "damper" may limit the frequency and/or magnitude of the configuration changes. In one specific instance, a set of peer EGM's may be restricted to conducting an analysis and configuration cycle no more than once a week, and any corresponding value changes to the configuration parameters must be made in predefined increments. As another option, one or more of the configuration parameters may be limited by a respective minimum value, maximum value, range, etc. These minimums, maximums, and ranges may be "learned" values determined by the P2P network. These minimums, maximums, and ranges may be may be built into the system by the software provider, client, third party vendor, state regulatory agency, or any combination thereof.

In accord with some of the disclosed concepts, the peer gaming machines may be operable to initiate a configuration cycle in response to environmental information. For instance, a free-standing gaming terminal may monitor the number of patrons waiting to use that gaming terminal or, alternatively, the number of patrons waiting to use a neighboring peer terminal. In so doing, the gaming terminal may determine that there are a number of patrons that are waiting for a prolonged period of time. If it is determined that the amount of waiting patrons exceeds an acceptable threshold number of players and/or it is determined that the waiting patrons have been waiting for longer than an acceptable threshold period of time, a reconfiguration cycle can be implemented. In an instance where the subject gaming terminal is monitoring the number of patrons waiting to use that gaming terminal, the subject gaming terminal can broadcast or otherwise transmit a signal to one or more neighboring peer terminals to reconfigure themselves to make available one or more of the gaming features available on the busy subject terminal. Alternatively, if the subject gaming terminal is monitoring the number of patrons waiting to use a neighboring peer terminal that is very busy, the subject gaming terminal can reconfigure itself to make available one or more of the gaming features available on the neighboring terminal. Optionally, one or more of the peer gaming terminals may display, e.g., via a marquee or secondary display device, the availability of a nearby peer terminal that has been reconfigured to offer similar gaming features for which the patrons are waiting to play.

In accord with some of the disclosed concepts, one or more of the configuration parameters of the gaming machine that are modified during the analysis and configuration cycle affects one or more settings of a hardware component of the gaming machine. That is, in addition to exchanging information to increase yield, the P2P network can also be used to exchange information to optimize machine functionality. From the knowledge provided by neighboring EGM's, for example, one or more of the configuration parameters of a peer EGM can be changed to improve power management or to attract new patrons. For instance, display settings of various lighting, speaker and/or display componentry can be reconfigured to save power and/or to attract passing patrons. This may include establishing specific time periods during which a primary display, a secondary display, and/or a top box marquee is turned on (e.g., during high traffic periods at that location) or off (e.g., during low traffic periods at that location). As another option, the activation, deactivation, and speed of onboard cooling fans can be reconfigured to operate at optimal times and speeds for a particular location based on location-specific environmental information provided by neighboring EGM's.

The P2P network can also be employed for preventative maintenance purposes. By way of illustration, an EGM can use to the P2P network to share and compare metrics with neighboring EGM's to look for anomalies and determine if there is a potential malfunction scenario, which can then be flagged and reported in a timely and efficient manner. For example, a subject EGM may compare its internal ambient temperature with that of its neighboring terminals to determine if a potential cooling fan malfunction has occurred or a peripheral component is possibly overheating due to in internal malfunction. During this comparison, the subject EGM may determine that its internal ambient temperature has gone up by 5° but the internal ambient temperatures of its neighboring terminals have not. In this example, such an increase in temperate may be decidedly abnormal and, thus, may be indicative of a malfunctioning cooling fan or an overheating peripheral component. Alternatively, if the comparison shows that the internal ambient temperatures of all of the peer EGM's in a particular location have gone up, it may just be due to a change in weather or external cooling at that location. As another example, a subject EGM may compare its power usage (e.g., current draw) with that of its neighboring terminals to determine if there is a potential malfunction. If the current draw of the subject EGM is significantly higher than a similarly outfitted neighbor EGM, the subject EGM may be failing.

As noted above, information may be collected and distributed by the peer EGM's in a variety of different ways. As another example, a series of optimization messages can be circulated on the P2P network to all of the peer EGM's. These messages can include previously collected information and, optionally, may prompt each receiving terminal to supplement the message with newly collected data for subsequent recirculation. One or more of these messages may include a tag with key words to find and circulate specific types of information between the EGMs. Moreover, new parameters can subsequently be added to and, thus, disseminated with these circulating messages. A new parameter may be one that was not originally anticipated as being particularly relevant to the analysis and configuration process, but has now been shown as a measure that a machine is either performing well or not performing well. These circulating messages can also be used to inject new or different sets of rules into the system. This method eliminates the need to permanently store the accumulated data on a resident memory device or in a database.

As indicated above, it may be desirable in some embodiments to configure a wagering game machine in a way that incentivizes a particular player demographic, such as players at a particular location within a particular casino, to play on that machine. For example, it may be determined by the PSP network that a casino may have a particular room where the average bet on the EGM's in that room is approximately 50-60 cents; the PSP network can then configure the gaming machines to ensure that the minimum and maximum wager options are configured to coincide with and exploit that average. Conversely, in another location within that same casino (or another casino altogether) the average bet on the EGM's is approximately $1.05; those gaming machines would be configured by the P2P network to ensure that the minimum and maximum bet options coincide with that average. This will help to ensure that players will not only be drawn to those machines, but when actually playing on those machines, their average bet is at least on par with the average bet for that location.

In some embodiments, the method 500 includes at least those steps enumerated above. It is also within the scope and spirit of the present invention to omit steps, include additional steps, and/or modify the order presented above. It should be further noted that the method 500 represents a single cycle for configuring one or more gaming devices. However, it is expected that the method 500 be applied in a systematic and repetitive manner.

The disclosed methods and features can be applied to a variety of different gaming systems, including those with standalone EGM's, portable hand-held gaming devices, gaming machine banks, local area progressive (LAP) and wide area progressive (WAP) arrangements, and on-line meta theme experiences. For example, P2P network configuration may be at the individual EGM level or at the bank level or at the LAP/WAP level.

In some embodiments of the disclosed concepts, an EGM collects emotion capture data or simple coin-in yields for various game configurations and, without manual intervention, without configuration "wizards," and without set up screens, automatically communicates proposed configuration adjustments to other networked EGM's based on this collected data. For example, a particular theme's bonus round may prove to more popular than others; the peer-to-peer network of terminals "talk" and "agree" to utilize that theme's bonus round more frequently. This is not necessarily restricted to game theme, and could be used as well with an EGM (e.g., a default hue on one EGM is shown to attract more players than other colors; all EGM's adjust their default hue to be the same).

Aspects of this disclosure can be implemented, in some embodiments, through a computer-executable program of instructions, such as program modules, generally referred to as software applications or application programs executed by a computer. The software can include, in non-limiting examples, routines, programs, objects, components, and data structures that perform particular tasks or implement particular abstract data types. The software can form an interface to allow a computer to react according to a source of input. The software can also cooperate with other code segments to initiate a variety of tasks in response to data received in conjunction with the source of the received data. The software can be stored on any of a variety of memory media, such as CD-ROM, magnetic disk, bubble memory, and semiconductor memory (e.g., various types of RAM or ROM).

Moreover, aspects of the present disclosure can be practiced with a variety of computer-system and computer-network configurations, including hand-held devices, multiprocessor systems, microprocessor-based or programmable-consumer electronics, minicomputers, mainframe computers, and the like. In addition, aspects of the present disclosure can be practiced in distributed-computing environments where tasks are performed by remote-processing devices that are linked through a communications network. In a distributed-computing environment, program modules can be located in both local and remote computer-storage media including memory storage devices. Aspects of the present disclosure can therefore, be implemented in connection with various hardware, software or a combination thereof, in a computer system or other processing system.

Any of the methods described herein can include machine readable instructions for execution by: (a) a processor, (b) a controller, and/or (c) any other suitable processing device. Any algorithm, software, or method disclosed herein can be embodied in software stored on a tangible medium such as, for example, a flash memory, a CD-ROM, a floppy disk, a hard drive, a digital versatile disk (DVD), or other memory devices, but persons of ordinary skill in the art will readily appreciate that the entire algorithm and/or parts thereof could alternatively be executed by a device other than a controller and/or embodied in firmware or dedicated hardware in a well-known manner (e.g., it can be implemented by an application specific integrated circuit (ASIC), a programmable logic device (PLD), a field programmable logic device (FPLD), discrete logic, etc.). Also, some or all of the machine readable instructions represented in any flowchart depicted herein can be implemented manually. Further, although specific algorithms are described with reference to flowcharts depicted herein, persons of ordinary skill in the art will readily appreciate that many other methods of implementing the example machine readable instructions can alternatively be used. For example, the order of execution of the blocks can be changed, and/or some of the blocks described can be changed, eliminated, or combined.

It should be noted that the algorithms illustrated and discussed herein as having various modules or blocks or steps that perform particular functions and interact with one another are provided purely for the sake of illustration and explanation. It should be understood that these modules are merely segregated based on their function for the sake of description and represent computer hardware and/or executable software code which can be stored on a computer-readable medium for execution on appropriate computing hardware. The various functions of the different modules and units can be combined or segregated as hardware and/or software stored on a non-transitory computer-readable medium as above as modules in any manner, and can be used separately or in combination.

While many representative embodiments and exemplary modes for carrying out the present invention have been described in detail above, those familiar with the art to which this invention relates will recognize various alternative designs and embodiments for practicing the invention within the scope of the appended claims.

What is claimed is:

1. A gaming machine for communicatively coupling to one or more peer gaming machines via a peer-to-peer gaming network, the gaming machine comprising:

one or more display devices;

one or more processors; and one or more memory devices storing instructions that, when executed by at least one of the one or more processors, cause the gaming machine to:

store, via at least one of the one or more memory devices, a first set of data indicative of configuration parameters of the gaming machine, and a second set of data indicative of machine performance of the gaming machine;

receive, from the one or more peer gaming machines via the peer-to-peer gaming network, a third set of data indicative of configuration parameters of the one or more peer gaming machines, and a fourth set of data indicative of machine performance of the one or more peer gaming machines;

analyze, via at least one of the one or more processors, the third and fourth sets of data to determine one or more modifications to the configuration parameters of the gaming machine to thereby improve the machine performance of the gaming machine; and automatically modify at least one of the configuration parameters of the gaming machine based upon the results of the analysis.

2. The gaming machine of claim 1, wherein the machine performance of the gaming machine includes a statistical analysis of at least one of coin in data, payout data, and occupancy data of the gaming machine.

3. The gaming machine of claim 1, wherein the modified at least one configuration parameter of the gaming machine affects the mathematical configuration of a wagering game available for play on the gaming machine.

4. The gaming machine of claim 1, wherein the modified at least one configuration parameter of the gaming machine affects one or more settings of a hardware component of the gaming machine.

5. The gaming machine of claim 1, wherein the modified at least one configuration parameter of the gaming machine includes at least one of a line count, an available payline count, a maximum available bet, a minimum available bet, and a button panel wagering configuration.

6. The gaming machine of claim 1, wherein the analyzing the third and fourth sets of data to determine one or more modifications to the configuration parameters of the gaming machine is based on a predefined rule set.

7. The gaming machine of claim 1, wherein the stored instructions further cause the gaming machine to transmit to the one or more peer gaming machines a recommended modification to at least one of the configuration parameters of the one or more peer gaming machines to thereby improve the machine performance of the one or more peer gaming machines.

8. The gaming machine of claim 1, wherein the stored instructions further cause the gaming machine to transmit the first and second sets of data to the one or more peer gaming machines via the peer-to-peer gaming network.

9. The gaming machine of claim 1, wherein the stored instructions further cause the gaming machine to store, via at least one of the one or more memory devices, the third and fourth sets of data received from the one or more peer gaming machines.

10. The gaming machine of claim 1, wherein the stored instructions further cause the gaming machine to schedule a configuration cycle for the gaming machine.

11. The gaming machine of claim 1, wherein the stored instructions further cause the gaming machine to schedule a collection cycle for collecting data from the gaming machine.

12. The gaming machine of claim 1, wherein the stored instructions further cause the gaming machine to schedule a transmit cycle for transmitting data to the one or more peer gaming machines.

13. The gaming machine of claim 1, wherein the gaming machine and the one or more peer gaming machines share a common location.

14. One or more physical machine-readable storage media including instructions which, when executed by one or more processors, cause the one or more processors to perform operations comprising:

store on at least one memory device a first set of data indicative of configuration parameters of a gaming machine, and a second set of data indicative of machine performance of the gaming machine;

receive from a peer gaming machine via a peer-to-peer gaming network a third set of data indicative of configuration parameters of the peer gaming machine, and a fourth set of data indicative of machine performance of the peer gaming machine;

analyze the third and fourth sets of data to determine one or more modifications to the configuration parameters of the gaming machine to thereby improve the machine performance of the gaming machine; and automatically modify at least one of the configuration parameters of the gaming machine based upon the results of the analysis.

15. A method of configuring gaming machines communicatively coupled together via a peer-to-peer gaming network, the method comprising:

storing, on a first one of the gaming machines, a first set of data indicative of configuration parameters of the first gaming machine, and a second set of data indicative of machine performance of the first gaming machine;

storing, on a second one of the gaming machines, a third set of data indicative of configuration parameters of the second gaming machine, and a fourth set of data indicative of machine performance of the second gaming machine;

transmitting the third set of data and the fourth set of data from the second gaming machine to the first gaming machine;

analyzing, via the first gaming machine, the third and fourth sets of data to determine one or more modifications to the configuration parameters of the first gaming machine to thereby improve the machine performance of the first gaming machine; and automatically modifying at least one of the configuration parameters of the first gaming machine based upon the results of the analysis.

16. The method of claim 15, wherein the machine performance of the first gaming machine includes a statistical analysis of at least one of coin in data, payout data, and occupancy data of the first gaming machine.

17. The method of claim 15, wherein the modified at least one configuration parameter of the first gaming machine affects the mathematical configuration of a wagering game available for play on the first gaming machine.

18. The method of claim 15, wherein the modified at least one configuration parameter of the first gaming machine includes at least one of a line count, an available payline count, a maximum available bet, a minimum available bet, and a button panel wagering configuration.

19. The method of claim 15, wherein the analyzing the third and fourth sets of data to determine one or more modifications to the configuration parameters of the first gaming machine is based on a predefined rule set.

20. The method of claim 15, further comprising transmitting from the second gaming machine to the first gaming machine a recommended modification to at least one of the configuration parameters of the first gaming machine to thereby improve the machine performance of the first gaming machine.

21. The method of claim 15, further comprising transmitting the first and second sets of data from the first gaming machine to the second gaming machine.

22. The method of claim 15, further comprising storing on the first gaming machine the third and fourth sets of data received from the second gaming machine.

23. The method of claim 15, wherein the analyzing the third and fourth sets of data to determine one or more modifications to the configuration parameters of the gaming machine is based on a common location shared by the first and second gaming machines.

24. One or more physical machine-readable storage media including instructions which, when executed by one or more processors resident to a gaming machine, cause the one or more processors to perform operations comprising:

store on a memory device resident to the gaming machine, a first set of data indicative of configuration parameters of the gaming machine, and a second set of data indicative of machine performance of the gaming machine;

receive from a peer gaming machine via a peer-to-peer gaming network a third set of data indicative of configuration parameters of the peer gaming machine, and a fourth set of data indicative of machine performance of the peer gaming machine;

analyze the received data via at least one of the one or more processors resident to the gaming machine to determine if the machine performance of the peer gaming machine is better than the machine performance of the gaming machine; and responsive to the results of the analysis, modify at least one of the configuration parameters of the gaming machine based upon the configuration parameters of the peer gaming machine.

25. A gaming system for conducting a wagering game, the gaming system comprising:

a plurality of gaming machines each having a respective display device, a respective memory device, and a respective communication interface, each of the respective communication interfaces being configured to receive data and transmit data, each of the gaming machines being configured to store data on the respective memory device; and a peer-to-peer network communicatively coupling the plurality of gaming machines together, wherein each of the gaming machines is operable to selectively transfer machine performance data and machine configuration data to the other gaming machines on the peer-to-peer network;

wherein each of the gaming machines is operable to analyze the data transferred thereto via the other gaming machines on the peer-to-peer network; and wherein each of the gaming machines is operable to modify one or more configuration parameters of the gaming machine based on the analyzed data transferred thereto via the other gaming machines on the peer-to-peer network.

* * * * *